US011661715B2

(12) United States Patent
Butler et al.

(10) Patent No.: US 11,661,715 B2
(45) Date of Patent: May 30, 2023

(54) MANHOLE GUARD AND ATTACHABLE WINCH MOUNT

(71) Applicant: ButlerBilt L.L.C., Flat Rock, MI (US)

(72) Inventors: Michael Butler, Flat Rock, MI (US); John Lambert, Newport, MI (US)

(73) Assignee: ButlerBilt L.L.C., Flat Rock, MI (US)

( * ) Notice: Subject to any disclaimer, the term of this patent is extended or adjusted under 35 U.S.C. 154(b) by 264 days.

(21) Appl. No.: 16/943,469

(22) Filed: Jul. 30, 2020

(65) Prior Publication Data

US 2021/0032821 A1 Feb. 4, 2021

Related U.S. Application Data

(60) Provisional application No. 62/880,802, filed on Jul. 31, 2019.

(51) Int. Cl.

| | |
|---|---|
| ***E01F 13/02*** | (2006.01) |
| ***B66D 3/26*** | (2006.01) |
| ***B66F 19/00*** | (2006.01) |

(52) U.S. Cl.

CPC ..... *E01F 13/02* (2013.01); *B66D 3/26* (2013.01); *B66F 19/005* (2013.01)

(58) Field of Classification Search

CPC .... A62B 1/02; A62B 1/04; B66D 1/60; B66D 1/605; B66F 19/005; E01F 9/688; E01F 9/692; E01F 13/00; E01F 13/02

See application file for complete search history.

(56) References Cited

U.S. PATENT DOCUMENTS

| | | | | | |
|---|---|---|---|---|---|
| 1,688,074 | A | * | 10/1928 | Goff | E01F 13/02 52/646 |
| 1,741,323 | A | * | 12/1929 | Lufkin | E01F 13/02 52/646 |
| 1,882,150 | A | * | 10/1932 | Kent | E01F 13/02 52/646 |
| 3,444,793 | A | * | 5/1969 | Pelsue | E01F 13/02 404/25 |
| 5,022,489 | A | * | 6/1991 | Sauber | A62B 1/00 212/166 |
| 5,035,336 | A | * | 7/1991 | Schmitz | B66F 19/005 212/343 |

(Continued)

FOREIGN PATENT DOCUMENTS

| | | | | |
|---|---|---|---|---|
| DE | 9207906 | U1 * | 11/1992 | E01F 13/02 |
| DE | 4300450 | A1 * | 7/1994 | E01F 13/02 |
| EP | 0347388 | A1 * | 12/1989 | E01F 13/02 |

*Primary Examiner* — Josh Skroupa

(74) *Attorney, Agent, or Firm* — MacMillan, Sobanski & Todd, LLC

(57) ABSTRACT

A manhole guard, methods of assembling the same, and methods of using the same, are described. The manhole guard generally includes a plurality of sections connected for movement, the sections being capable of being locked into a fixed rigid structure through the use of a first arm and second arm that act independently of each other. The manhole guard may include a safety net attached to one or more sections of the manhole guard. The manhole guard may include attachable mounting brackets designed to facilitate the attachment of a first hoist device and/or first winch and include attachable mounting members designed to facilitate the attachment of a second hoist device and/or second winch.

16 Claims, 36 Drawing Sheets

(56) References Cited

U.S. PATENT DOCUMENTS

| | | | | |
|---|---|---|---|---|
| 7,213,715 | B2 * | 5/2007 | Boily | A62B 1/08 212/179 |
| 10,190,273 | B2 * | 1/2019 | Butler | E01F 13/02 |
| 2008/0289905 | A1 * | 11/2008 | Pelsue | A62B 1/04 182/236 |

* cited by examiner

MANHOLE GUARD AND ATTACHABLE WINCH MOUNT

CROSS-REFERENCE TO RELATED APPLICATIONS

This application claims priority to U.S. Provisional Application No. 62/880,802 filed under 35 U.S.C. § 111(b) on Jul. 31, 2019, the entire disclosure of which is incorporated herein by reference for all purposes.

BACKGROUND

Manholes form an interface between the surface and subsurface. Manholes provide access to underground networks that contain vital infrastructure such as utility and sewage systems. To service this underground infrastructure, manholes must be temporarily uncovered to permit the transport of materials and personnel between the surface and subsurface.

Servicing this underground infrastructure poses a variety of safety concerns for workers and members of the general public. Materials need to be safely transported between the surface and subsurface without damage to supplies or injury to unsuspecting workers below. Workers need to be transported between the surface and subsurface without injury to the worker or, in the case of a worker injured below, to assist the injured worker. In addition, both workers and members of the general public run the risk of injury from falling into, or tripping over, uncovered manholes.

To address these and other safety concerns, portable manhole guards were created to safely identify and limit access to manholes that are temporarily uncovered. In addition, hoist devices were developed to be attached to manhole guards to safely transport materials and personnel between the surface and underground. However, conventional manhole guards and hoist devices suffer durability, accessibility, assembly, and portability problems. Thus, there is a need in the art for new and improved manhole guards.

SUMMARY

Provided herein is a manhole guard comprising a plurality of sections connected for movement, the sections comprising a center section, a first wing, and a second wing, wherein the center section comprises a first post and a second post connected by at least one center section rail, the first wing comprises a first wing post connected to the first post by at least one of an upper first wing rail and a lower first wing rail, and the second wing comprises a second wing post connected to the second post by at least one of an upper second wing rail and a lower second wing rail; a first mounting bracket connected to the first wing, and a second mounting bracket connected to the second wing; and a primary mounting member connected to the first wing and to the first mounting bracket, and a secondary mounting member connected to the second wing and to the second mounting bracket.

In certain embodiments, the primary mounting member comprises a primary body, a first primary arm connected to the primary body, and a second primary arm connected to the primary body; and wherein the secondary mounting member comprises a secondary body, a first secondary arm connected to the secondary body, and a second secondary arm connected to the secondary body.

In particular embodiments, the primary body further includes a primary body lower recess and a primary body upper recess; and wherein the secondary body includes a secondary body lower recess and a secondary body upper recess.

In particular embodiments, the primary body lower recess is configured to accept the upper first wing rail in an interference fit and the secondary body lower recess is configured to accept the upper second wing rail in an interference fit In particular embodiments, the first primary arm includes a first primary arm body and a first primary arm extension extending from the first primary arm body; and wherein the second primary arm includes a second primary arm body and a second primary arm extension extending from the second primary arm body.

In particular embodiments, the first primary arm extension includes a first primary arm extension opening; and wherein the second primary arm extension includes a second primary arm extension opening.

In particular embodiments, the primary mounting member further includes a primary bridging member extending between the first primary arm and the second primary arm and connected to the first primary arm and the second primary arm; and wherein the secondary mounting member further includes a secondary bridging member extending between the first secondary arm and the second secondary arm and connected to the first secondary arm and the second secondary arm.

In particular embodiments, the primary mounting member further includes a winch platform.

In particular embodiments, the winch platform is attached to the primary body, to the first primary arm, or to both the primary body and the first primary arm.

In particular embodiments, the first primary arm includes at least one first primary arm body opening.

In particular embodiments, a winch is attached to the winch platform.

In particular embodiments, one or more fasteners extend through the at least one first primary arm body opening to secure the winch to the winch platform.

In particular embodiments, the first primary arm includes a first primary arm recess.

In particular embodiments, the manhole guard further includes a first arm connected to the center section and capable of locking the first wing into a fixed position relative to the center section.

In particular embodiments, the manhole guard further includes a second arm connected to the center section and capable of locking the second wing into a fixed position relative to the center section.

In particular embodiments, the first arm and the second arm operate independently of each other.

In particular embodiments, at least one of the first arm or the second arm comprises a spring-loaded latch mechanism configured to accept either the first wing or the second wing.

In particular embodiments, the first mounting bracket has a first top recess, a first middle recess, and a first lower recess.

In particular embodiments, the first lower recess is configured to accept the first lower wing rail in an interference fit, and the first middle recess is configured to accept the first upper wing rail in an interference fit.

In particular embodiments, the second mounting bracket has a second top recess, a second middle recess, and a second lower recess.

In particular embodiments, the second lower recess is configured to accept the second lower wing rail in an interference fit, and the second middle recess is configured to accept the second upper wing rail in an interference fit.

In particular embodiments, the manhole guard further comprises a safety net attached to one or more of the first wing, the second wing, and the center section, the safety net being configured to block debris. In particular embodiments, the safety net includes a reflective material. In particular embodiments, the safety net includes a toe board.

In particular embodiments, the primary mounting member is fixed to the first mounting bracket by positioning the first mounting bracket between the first primary arm and the second primary arm, by positioning the first mounting bracket between the primary bridging member and the first primary arm extension opening and the second primary arm extension opening, and by inserting a primary fastener through the first primary arm extension opening and the second primary arm extension opening; and wherein the secondary mounting member is fixed to the second mounting bracket by positioning the second mounting bracket between the first secondary arm and the second secondary arm, by positioning the second mounting bracket between the secondary bridging member and the first secondary arm extension opening and the second secondary arm extension opening, and by inserting a secondary fastener through the first secondary arm extension opening and the second secondary arm extension opening.

Further provided is a manhole guard comprising a plurality of sections connected for movement, the sections including a center section, a first wing, and a second wing, wherein the center section comprises a first post and a second post connected by at least one center section rail, the first wing comprises a first wing post connected to the first post by at least one of an upper first wing rail and a lower first wing rail, and the second wing comprises a second wing post connected to the second post by at least one of an upper second wing rail and a lower second wing rail; a first hoist assembly comprising a first mounting bracket connected to the first wing, and a second mounting bracket connected to the second wing; and a second hoist assembly comprising a primary mounting member connected to the first wing and to the first mounting bracket, and a secondary mounting member connected to the second wing and to the second mounting bracket.

In certain embodiments, the manhole guard further comprises a safety net attached to one or more of the first wing, the second wing, and the center section. In particular embodiments, the safety net includes a reflective material. In particular embodiments, the safety net includes a toe board. In particular embodiments, the toe board is made from rubber.

Further provided is a manhole guard comprising a plurality of sections connected for movement, the sections including a center section, a first wing, and a second wing, wherein the center section comprises a first post and a second post connected by at least one center section rail, the first wing comprises a first wing post connected to the first post by at least one of an upper first wing rail and a lower first wing rail, and the second wing comprises a second wing post connected to the second post by at least one of an upper second wing rail and a lower second wing rail; and a safety net attached to one or more of the first wing, the second wing, and the center section.

In certain embodiments, the safety net includes one or more rail attachment features. In particular embodiments, the safety net includes one or more post attachment features. In particular embodiments, the safety net includes reflective tape. In particular embodiments, the safety net is made from a reflective material. In particular embodiments, the safety net includes a toe board.

Further provided is a hoist assembly for a manhole guard comprising a primary mounting member having a primary body, a first primary arm connected to the primary body, and a second primary arm connected to the primary body; a secondary mounting member having a secondary body, a first secondary arm connected to the secondary body, and a second secondary arm connected to the secondary body; a crossbar extending between the primary mounting member and the secondary mounting member and engaging the primary mounting member and the secondary mounting member; and a hoist device attached to the crossbar.

In certain embodiments, the primary body further includes a primary body lower recess and a primary body upper recess. In particular embodiments, the secondary body further includes a secondary body lower recess and a secondary body upper recess. In particular embodiments, the first primary arm includes a first primary arm body and a first primary arm extension extending from the first primary arm body. In particular embodiments, the second primary arm includes a second primary arm body and a second primary arm extension extending from the second primary arm body. In particular embodiments, the first primary arm extension includes a first primary arm extension opening, and wherein the second primary arm extension includes a second primary arm extension opening. In particular embodiments, the primary mounting member further includes a primary bridging member extending between the first primary arm and the second primary arm and connected to the first primary arm and the second primary arm; and the secondary mounting member further includes a secondary bridging member extending between the first secondary arm and the second secondary arm and connected to the first secondary arm and the second secondary arm.

In particular embodiments, the primary mounting member further includes a winch platform.

In particular embodiments, the winch platform is attached to the primary body or to the first primary arm or to both the primary body and the first primary arm.

In particular embodiments, a winch is attached to the winch platform.

In particular embodiments, the first primary arm includes at least one first primary arm body opening.

In particular embodiments, fasteners secure the winch to the winch platform using the at least one first primary arm body opening.

In particular embodiments, the first primary arm includes a first primary arm recess.

In particular embodiments, at least one of the primary arm extensions and secondary arm extensions is tapered.

Further provided is a primary mounting member for a manhole guard comprising a primary body having a primary body lower recess and a primary body upper recess, a first primary arm connected to the primary body, and a second primary arm connected to the primary body. In certain embodiments, the primary body lower recess is positioned on the primary body at an angle relative to the position of the primary body upper recess. In certain embodiments, the primary body upper recess is oriented in a direction that is transverse to the orientation of the primary body lower recess. In certain embodiments, the primary body is a hollow rectangular structure. In certain embodiments, the first primary arm includes a first primary arm body and a first primary arm extension extending from the first primary arm body. In particular embodiments, the second primary arm includes a second primary arm body and a second primary arm extension extending from the second primary arm body. In particular embodiments, the first primary arm body has at least one first primary arm body opening. In particular embodiments, the second primary arm body has at least one second primary arm body opening. In particular embodiments, at least one of the first primary arm extension and the second primary arm extension has a tapered end. In particular embodiments, the first primary arm extension includes a first primary arm extension opening. In particular embodiments, the second primary arm extension includes a second primary arm extension opening. In particular embodiments, the first primary arm extension and the second primary arm extension extend in the same direction such that the first primary arm extension opening and the second primary arm extension opening are aligned.

In certain embodiments, the first primary arm includes a first primary arm recess. In certain embodiments, a winch platform is attached to at least one of the primary body and the first primary arm. In particular embodiments, the winch platform is "L"-shaped.

Further provided is a safety barricade comprising a barricade structure; and a safety net attached to the barricade structure, wherein the safety net comprises one or more rail attachment features or post attachment features. In certain embodiments, the safety net includes reflective tape. In certain embodiments, the safety net is made from a reflective material. In certain embodiments, the safety net includes a toe board.

BRIEF DESCRIPTION OF THE DRAWINGS

FIG. 5A shows an elevated angled view of the second mounting bracket with a winch platform and mounting plate attached. FIG. 5B shows an exploded view of the second mounting bracket with a winch platform. FIG. 5C shows a lateral view of the first top recess of the first mounting bracket.

FIG. 7A is a perspective view of the manhole guard with mounting brackets and mounting members attached, and first and second arms securing the first and second wings into position. FIG. 7B is a first wing side view of the manhole guard with mounting brackets and mounting members attached.

FIG. 10A is a perspective view of the primary body. FIG. 10B is a side view of the primary body showing the primary body upper recess. FIG. 10C is a side view of the primary body showing the primary body lower recess. FIG. 10D is top view of the primary body showing the primary body upper recess.

FIG. 11A is a perspective view of the primary mounting member. FIG. 11B is a side view of the primary mounting member showing the first primary arm recess, primary body upper recess, primary bridging member, and winch platform. FIG. 11C is a top view of the primary mounting member. FIG. 11D is a side view of the primary mounting member showing the primary body, first and second primary arms, winch platform, and primary body lower recess.

FIG. 13A is a perspective view of the secondary body. FIG. 13B is a side view of the secondary body showing the secondary body upper recess. FIG. 13C is a side view of the secondary body showing the secondary body lower recess. FIG. 13D is top view of the secondary body showing the secondary body upper recess.

FIG. 14A is a perspective view of the secondary mounting member. FIG. 14B is a side view of the secondary mounting member showing a second secondary arm, a secondary body upper recess, and a secondary bridging member. FIG. 14C is a top view of the secondary mounting member. FIG. 14D is a side view of the secondary mounting member showing a secondary body, first and second secondary arms, and a secondary body lower recess.

FIG. 18A is a photograph of a manhole guard containing a safety net from the open front of the manhole guard.

FIG. 18B is a photograph of a manhole guard containing a safety net from the rear of the manhole guard.

DETAILED DESCRIPTION

Various embodiments are described in the present disclosure in the context of a manhole guard. Those of ordinary skill in the art will realize that the following detailed description of the embodiments is illustrative only and not intended to be in any way limiting. Other embodiments will readily suggest themselves to such skilled persons having the benefit of the disclosure. References to an "embodiment," "aspect," or "example" in this disclosure indicate that the embodiments of the invention so described may include a particular feature, structure, or characteristic, but not every embodiment necessarily includes the particular feature, structure, or characteristic. Further, repeated use of the phrase "in one embodiment" does not necessarily refer to the same embodiment, although it may.

Described herein is a manhole guard that addresses various problems in the art. The present disclosure provides a portable manhole guard that, in some embodiments, is easy to assemble, is durable, will not collapse while transporting weighted materials, is stable, is adjustable, is capable of folding flat on itself, and does not hinder access to a manhole during use. Furthermore, any suitable hoist device is capable of being easily attached to the manhole guard and supported by the frame and structure of the manhole guard. The manhole guard described herein thus has many advantages that provide improved durability, stability, and safety, and solve various problems related to manhole access and transport of weight between the surface and subsurface.

Figure 1:
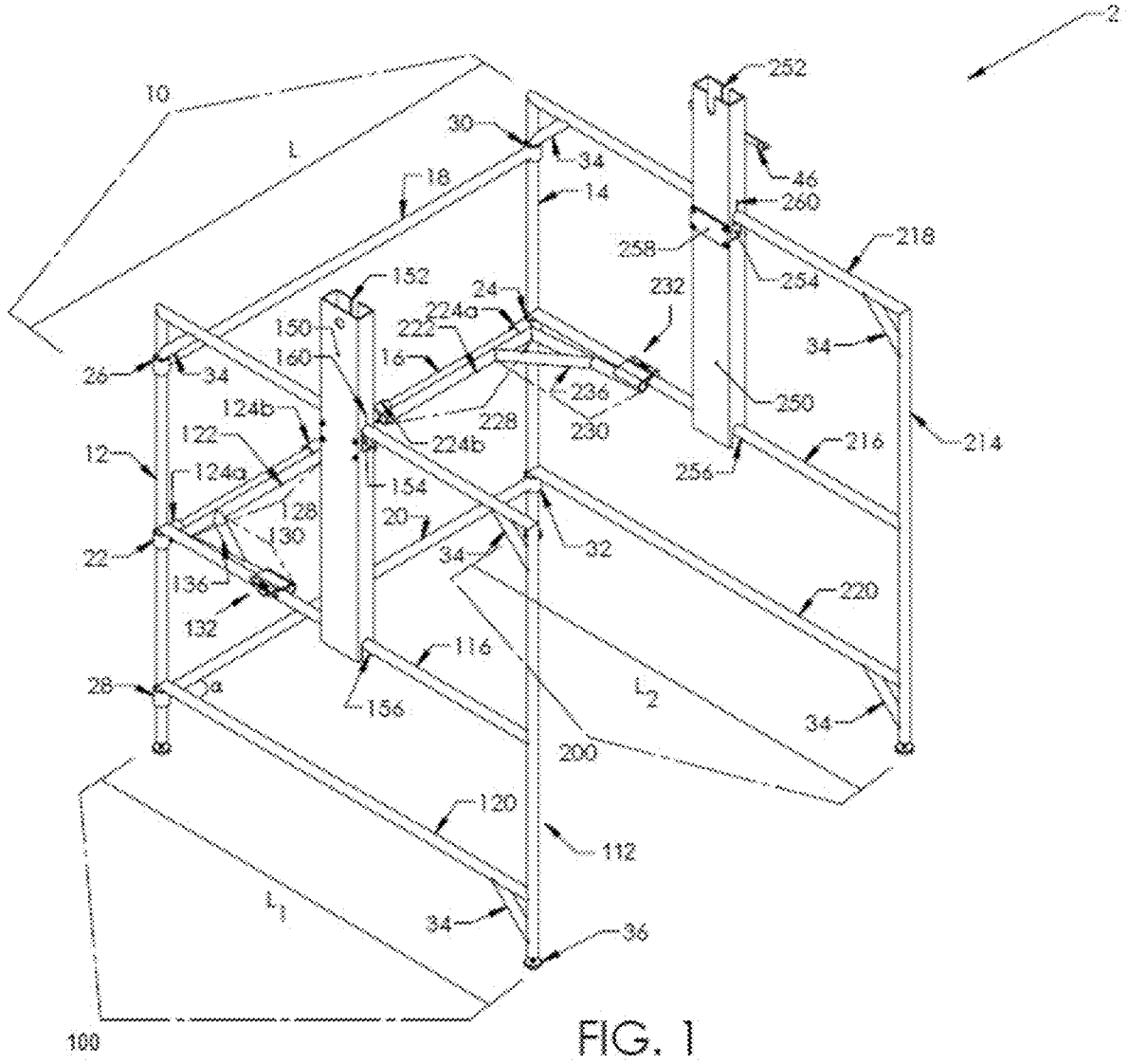
FIG. 1: Perspective view of the portable manhole guard with attachable mounting brackets for a hoist device and telescopically-fitted adjustable feet in accordance with the present disclosure.

As seen in FIG. 1, an embodiment of the manhole guard with two wings, when assembled, permits restricted access to an uncovered manhole. Restricted access, like that shown in FIG. 1, is important for the safe transportation of materials and personnel between the surface and subsurface through a manhole.

Referring now to FIGS. 1-4, an example embodiment of a manhole guard 2 generally has a plurality of sections connected for movement, the sections including a center section 10, a first wing 100, and a second wing 200. The connection for movement allows, for example, the first wing 100 and the second wing 200 to rotate around an axis defined by a first post 12 and a second post 14, respectively. This allows the manhole guard 2 to fold flat upon itself for easy transport, assembly, and storage.

The center section 10 has a first post 12 and a second post 14 that are connected by at least one center rail 16. In some embodiments, the first post 12 and the second post 14 are connected by multiple center rails 16, 18, 20. In one non-limiting example, the manhole guard 2 has three center rails (an upper center rail 18, a middle center rail 16, and a lower center rail 20) extending between, and connecting, the first post 12 and the second post 14. In use, the first post 12 and the second post 14 rest on the ground or other surface in proximity to a manhole.

A first wing 100 is pivotably or hingedly connected to the first post 12 such that the first wing 100 can rotate around the axis defined by the first post 12. The first wing 100 has a first wing post 112 that connects to the first post 12 of the center section 10 by at least one first wing rail 116. In some embodiments, the first wing post 112 is connected to the first post 12 by multiple first wing rails 116, 118, 120. By way of a non-limiting example, the first wing 100 may include an upper first wing rail 118, a middle first wing rail 116, and a lower first wing rail 120, all of which extend between, and connect, the first wing post 112 and the first post 12.

A second wing 200 is pivotably or hingedly connected to the second post 14 such that the second wing 200 can rotate around the axis defined by the second post 14. The second wing 200 has a second wing post 214 that connects to the second post 14 of the center section 10 by at least one second wing rail 216. In some embodiments, the second wing post 214 is connected to the second post 14 by multiple second wing rails 216, 218, 220. By way of a non-limiting example, the second wing 200 may include an upper second wing rail 218, a middle second wing rail 216, and a lower second wing rail 220, all of which extend between, and connect, the second wing post 214 and the second post 14.

The first post 12 has at least one first post hinge 22 comprising an internal pivot and external pivot which permit radial rotation of the first wing 100 around the axis defined by the first post 12. Alternatively, the first post hinge 22 can be a hollow circular end of the center rail 16 that the first post 12 runs through in a manner so as to allow the rotation of the first post 12 in the hollow circular end. Similarly, the second post 14 has at least one second post hinge 24 comprising an internal pivot and external pivot which permit radial rotation of the second wing 200 around the axis defined by the second post 14. Alternatively, the second post hinge 24 can be a hollow circular end of the center rail 16 that the second post 14 runs through in a manner so as to allow the rotation of the second post 14 in the hollow circular end. The first post 12 may further include an upper first post hinge 26 and a lower first post hinge 28, and the second post 14 may further include an upper second post hinge 30 and a lower second post hinge 32. Any hinge may further include a welded gusset for added strength and rigidity.

In some embodiments, the height of each wing's lower rail 120, 220, middle rail 116, 216, and upper rail 118, 218, relative to the height of the lower center rail 20, middle center rail 16, and upper center rail 18, is independently customizable. By way of a non-limiting example, in one embodiment, such as depicted in FIG. 1, the first upper wing rail 118 is at a height relative to the ground or other surface equal to that of the upper second wing rail 218, which is different from that of the upper center rail 18.

In some embodiments, in order to prevent access to an open manhole, one or more (preferably two) chains can be run from the first wing 100 to the second wing 200. The chains are attached at one end to the first wing post 112, and at the other end to the second wing post 214. The chains can be made of stainless steel or any other suitable material. At one of the wing posts 112, 214, each chain can be connected to a clip hanging off a ring welded to the wing post 112, 214. At the other wing post 112, 214, each chain can removably clip to a ring affixed to the wing post 112, 214. In use, the chains are simply clipped onto the wing post 112, 214 to which they are not already affixed, thereby creating a barrier that hinders access to the manhole which the manhole guard 2 surrounds.

In another embodiment, the manhole guard 2 has a third wing in addition to the center section 10, first wing 100, and second wing 200. The third wing can be attached to the first wing post 112 and second wing post 214 to entirely surround an uncovered manhole and obstruct any access to the manhole. Embodiments containing a third wing thus provide for enhanced safety surrounding an open manhole.

In some embodiments, the manhole guard 2 has one or more support rails 34 that reinforce the manhole guard structure. Generally, a support rail 34 can be utilized to connect any wing rail to an adjacent post or wing post. Furthermore, a support rail 34 can be utilized to connect any wing rail 116, 118, 120, 216, 218, 220 to any rail or wing post in the same wing. By way of one non-limiting example, and as depicted in FIG. 1, a support rail 34 can connect any of: the upper first wing rail 118 to the first wing post 112, the upper second wing rail 218 to the second wing post 214, the upper second wing rail 218 to the second post 14, and the upper first wing rail 118 to the first post 12. Support rails 34 can also be utilized to connect the lower first wing rail 120 to the first post 12, the lower first wing rail 120 to the first wing post 112, the lower second wing rail 220 to the second post 14, or the lower second wing rail 220 to the second wing post 214. By utilizing one or more support rails 34 to connect a wing rail to an adjacent wing post, the entire manhole guard structure can be reinforced.

In an alternative embodiment, instead of using support rails 34, the upper first wing rail 118, the first post 12, and the first wing post 112 can be manufactured as one solid piece with a slight curve where the first post 12 meets the upper first wing rail 118, and where the first wing post 112 meets the upper first wing rail 118. Similarly, the upper second wing rail 218, the second post 14, and the second wing post 214 can be manufactured as one solid piece with a slight curve where the second post 14 meets the upper second wing rail 218, and where the second wing post 214 meets the upper second wing rail 218. This method of manufacturing the manhole guard reduces the costs production, and can result in increased stability of the manhole guard.

Figure 2:
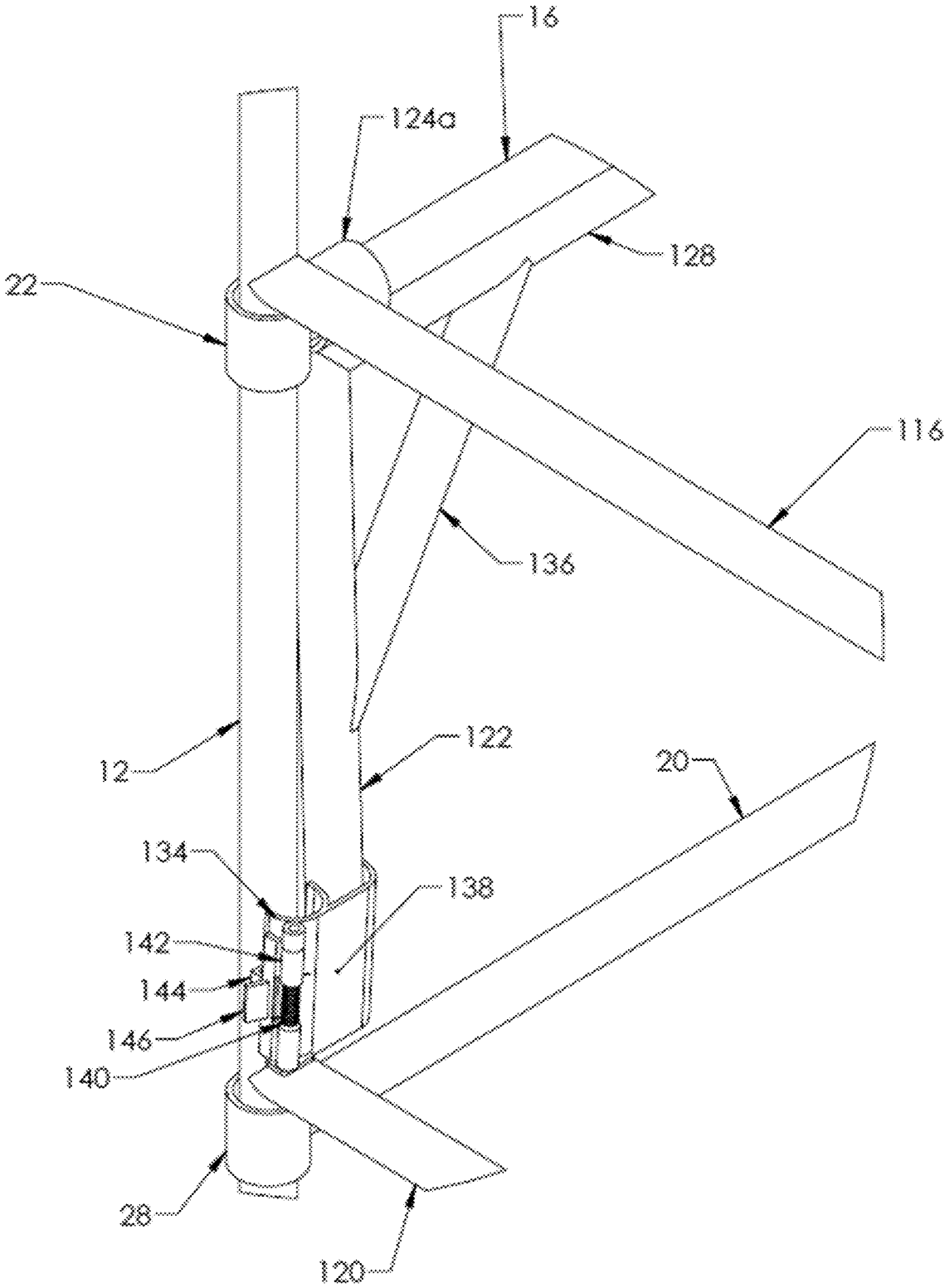
FIG. 2: View of a first arm in an unlocked position. When in use, the first arm may lock the first wing of the manhole guard into a fixed position. The second arm may lock the second wing of the manhole guard into a fixed position.

As depicted in FIGS. 1-2, the manhole guard 2 may include a first arm 122 and a second arm 222 that operate independently of each other. The first arm 122 is connected to the center section 10 on the center rail 16, and is capable of locking the first wing 100 into a fixed position relative to the center section 10. The second arm 222 is connected to the center section 10 on the center rail 16, and is capable of locking the second wing 200 into a fixed position relative to the center section 10. The independent operation of each arm allows for a variety of possible configurations of the manhole guard 2, thereby permitting the user to alter the access to the uncovered manhole for transport purposes or to account for any obstruction where the manhole is located. For example, the first arm 122 can be utilized to lock the first wing 100 in a fixed position relative to the center section 10 while the second wing 200 is not locked in a fixed position relative to the center section 10, and vice versa.

As seen in the embodiment of FIG. 2, the first arm 122 and second arm 222 are pivotably or hingedly connected to a center rail 16 of the center section. In embodiments where the center section 10 has multiple center rails, the first arm 122 and the second arm 222 are generally connected to the middle center rail 16 for optimal stability of the manhole guard 2. By way of a non-limiting example, in one embodiment, the first arm 122 and the second arm 222 each has a plurality of hinged attachments 124*a*, 124*b*, 224*a*, 224*b* to the center rail 16 of the center section 10. Multiple points of connection between the first arm 122 and center rail 16, and the second arm 222 and the center rail 16, lead to a stronger, longer-lasting attachment of each arm 122, 222 to the center rail 16 and ensure better distribution of force throughout an arm 122, 222 when the arm 122, 222 is in use. In other embodiments, due to the fact that the first arm 122 and the second arm 222 operate independently, the first arm 122 and the second arm 222 can be connected to different rails in the center section 10. As a non-limiting example of such an embodiment, the first arm 122 can be connected to the center section 10 at the center rail 16 while the second arm 222 is connected to the center section 10 at the upper center rail 18. As another non-limiting example, the second arm 222 can be connected to the center section 10 at the upper center rail 18 while the first arm 122 is connected to the center section 10 at the lower center rail 20.

The hinged attachment of the first and second arms 122, 222 to a rail in the center section 10 permits the first and second arms 122, 222 to each independently move between an unlocked position and a locked position. In the unlocked position, each arm 122, 222 can be co-planar with the center section 10 (i.e., the arm can be parallel to the first and second posts 12, 14), but even if the arm is not fully co-planar with the center section 10, the respective wing can be unlocked. That is, so long as the arm 122, 222 is not in a locked position, the corresponding wing 100, 200 is free to rotate about the axis of the respective post 12, 14. In the locked position, as depicted in FIG. 1 and FIG. 7, the arm 122, 222 is attached to the corresponding wing 100, 200, thereby preventing the wing 100, 200 from rotating about the axis of the respective post 12, 14. In the locked position, the first or second arm 122, 222 locks the respective wing 100, 200 in place with respect to the center section 10. In certain embodiments, the locked position preferably results in the first wing 100 extending at an angle $\alpha$ of about 90 degrees from the center section 10, and the second wing 200 extending at an angle $\beta$ of about 90 degrees from the center section 10, such that the three sections 10, 100, 200 form three sides of a square. It is understood, however, that the lengths of the center section 10, first wing 100, and second wing 200 ($L$, $L_1$, and $L_2$, respectively) need not be equal, in which case the preferable locked position forms a rectangle instead of a square. In certain embodiments, the first and second arms 122, 222 are configured such that the manhole guard 2 can fold flat on itself when the arms 122, 222 are in a specific unlocked position, as depicted in part in FIG. 2.

In some embodiments, each arm 122, 222 is separable from the manhole guard 2. However, several benefits are recognized by a pivotable or hinged attachment of each arm 122, 222 to the manhole guard 2 in general. A pivotable or hinged attachment prevents an arm or arms from being misplaced or lost. Furthermore, a pivotable or hinged attachment of the arms 122, 222 facilitates easier transport and assembly of the manhole guard 2 because there are fewer parts to carry and connect when the arms 122, 222 are attached.

In some embodiments, the first arm 122 and the second arm 222 have telescopically fitted extensions. The extensions permit the arms to be expanded and contracted as necessary. As a result, the manhole guard 2 is capable of assuming a variety of configurations while maintaining stability due to the first and second arms 122, 222 reinforcing the manhole guard structure.

Figure 3B:
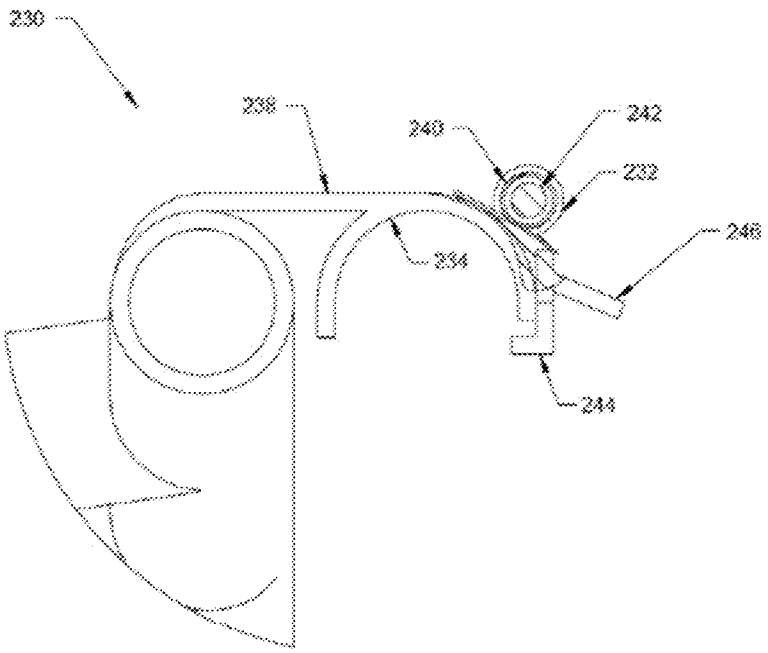
FIGS. 3A-3B: Lateral views of a latch mechanism on the first arm (FIG. 3A), which is used to secure the first wing into a fixed position, and a latch mechanism on the second arm (FIG. 3B), which may be used to secure the second wing into a fixed position.
Figure 3A:
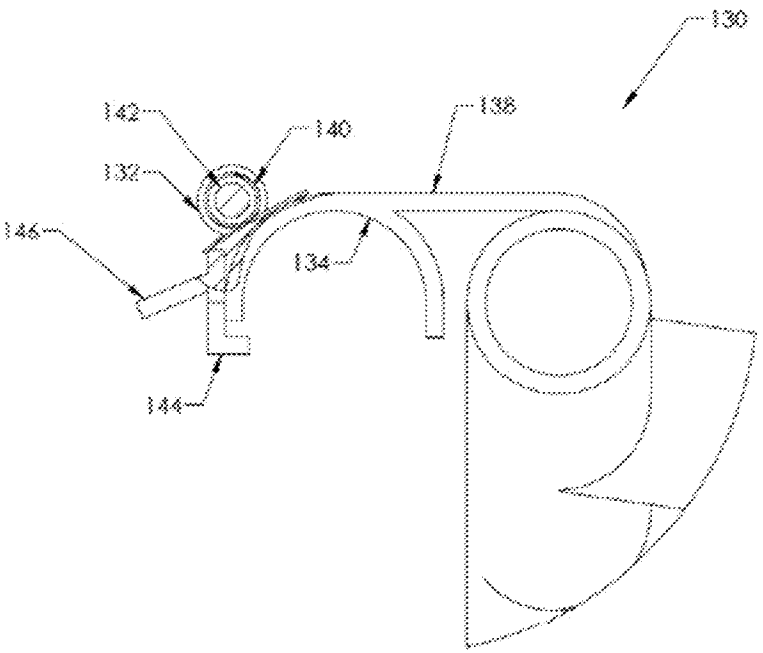

As depicted in FIGS. 3A-3B, the first and second arms 122, 222 each have a hinged end 128, 228 that attaches to the center section 10 (preferably, though not necessarily, at the center rail 16), and a wing end 130, 230 that attaches to the respective wing 100, 200. The hinged end 128, 228 is typically a metal railing that can be attached to the center section 10 through the use of multiple hinges 124*a*, 124*b*, 224*a*, 224*b* which assist in more evenly displacing force throughout the manhole guard 2. The wing end 128, 228 defines a latch mechanism 132, 232 coupled with a curved capping 134, 234 portion designed to fit securely over at least half the circumference of the wing rail 116, 216 being locked into place, as illustrated in FIGS. 3A-3B. In some embodiments, the first arm 122 and second arm 222 each has at least one support arm 136, 236 that connects the arm's hinged end 128, 228 to the arm's wing end 130, 230. In one non-limiting example, the support arm 136, 236 creates a triangular reinforcement between the respective arm's hinged end 128, 228 and wing end 130, 230.

The first and second arms 122, 222 can each include a latch mechanism (a first latch mechanism 132 and a second latch mechanism 232, respectively) located at the wing end 130, 230. In an alternative embodiment, only one of the arms 122, 222 includes a latch mechanism 132, 232. Each latch mechanism 132, 232 permits the respective wing 100, 200 to be securely fastened to the center section 10. This ensures the manhole guard 2 remains in a fixed and stable position, which is important for weighted transportation by a hoist device. In certain embodiments, the latch mechanism 132, 232 is attached to the respective arm 122, 222 by a ball joint.

Each latch mechanism 132, 232 may have a hood 138, 238 housing the curved capping portion 134, 234, a spring 140, 240, a bolt 142, 242, a latch 144, 244, and a trigger 146, 246. The spring 140, 240 spans the bolt 142, 242. The spring-bolt combination can be in an unloaded or loaded state. To transition from an unloaded state to a loaded state, the trigger 146, 246 is depressed, which increases tension on the spring 140, 240 and thereby loads the latch mechanism 132, 232. The tension engages the latch 144, 244 which locks the latch 144, 244 onto a welded ridge on the wing rail 116, 216 and secures the curved capping portion 134, 234 to the wing rail 116, 216. In the alternative, the spring 140, 240 begins in the loaded position, in which case releasing the trigger 146, 246 releases tension on the spring 140, 240 and thus disengages the latch 144, 244, thereby unlocking the latch 144, 244. Regardless of whether the spring latch mechanism 132, 232 begins in a loaded or unloaded position, a hood 138, 238 covers the latch 144, 244 and trigger 146, 246 so as to protect the latch 144, 244 and trigger 146, 246 from damage. The hood 138, 238 is generally curved, but other shapes are possible. The first and second latch mechanisms 132, 232 connected to each respective arm 122, 222, and the multiple-hinged connection of each arm 122, 222 to the center section 10, together enable each arm 122, 222 to secure a wing section 100, 200 in a variety of configurations while still stabilizing the manhole guard 2.

Figure 4:
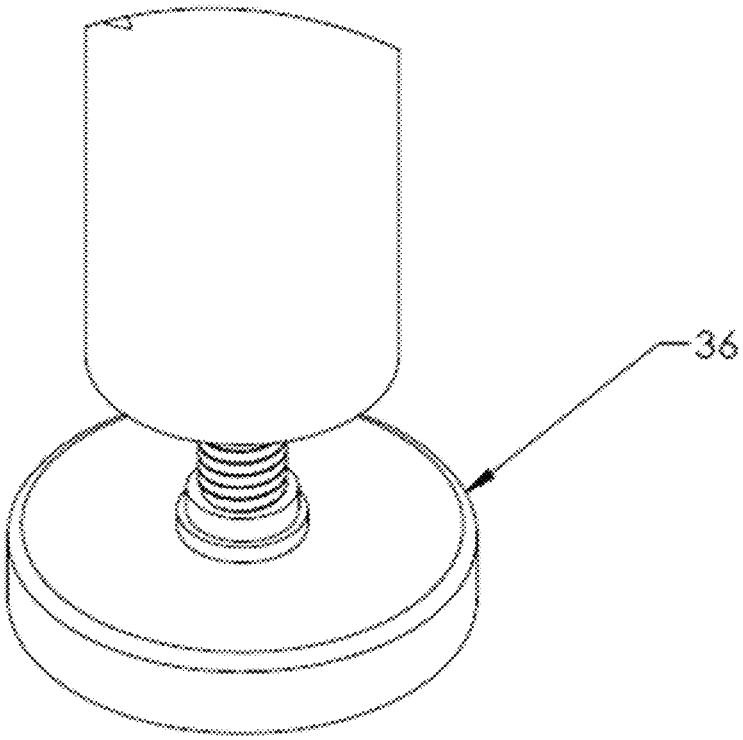
FIG. 4: View of a telescopically-fitted adjustable foot. The telescopically-fitted adjustable feet may be used to balance the manhole guard on the ground and adjust the height or level of the manhole guard.

As seen in FIG. 4, any of the first post 12, second post 14, first wing post 112, and/or second wing post 214 can include a telescopically fitted adjustable foot 36. The first post 12, second post 14, first wing post 112, and second wing post 214 are generally configured to rest on the ground or other surface surrounding a manhole. The telescopically fitted adjustable feet 36 can be adjusted up or down relative to the ground or other surface, such that the manhole guard 2 rests firmly and relatively flat on the ground or other surface regardless of whether the ground or other surface is uniformly level. Each adjustable foot 36 can include a ball joint that permits the adjustable foot 36 to have complete contact with an uneven surface.

Figure 5A:
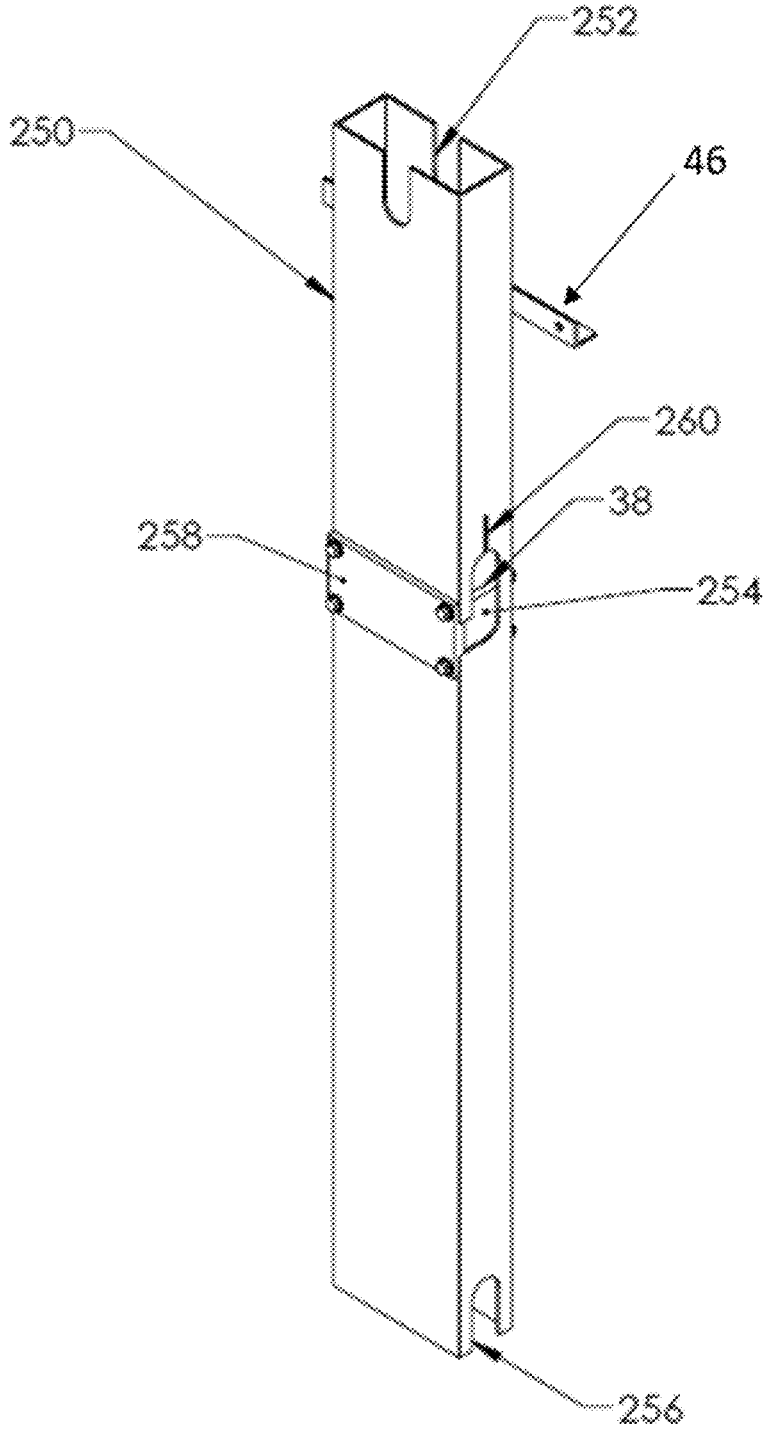
FIGS. 5A-5C: Views of non-limiting example configurations of mounting brackets.
Figure 5B:
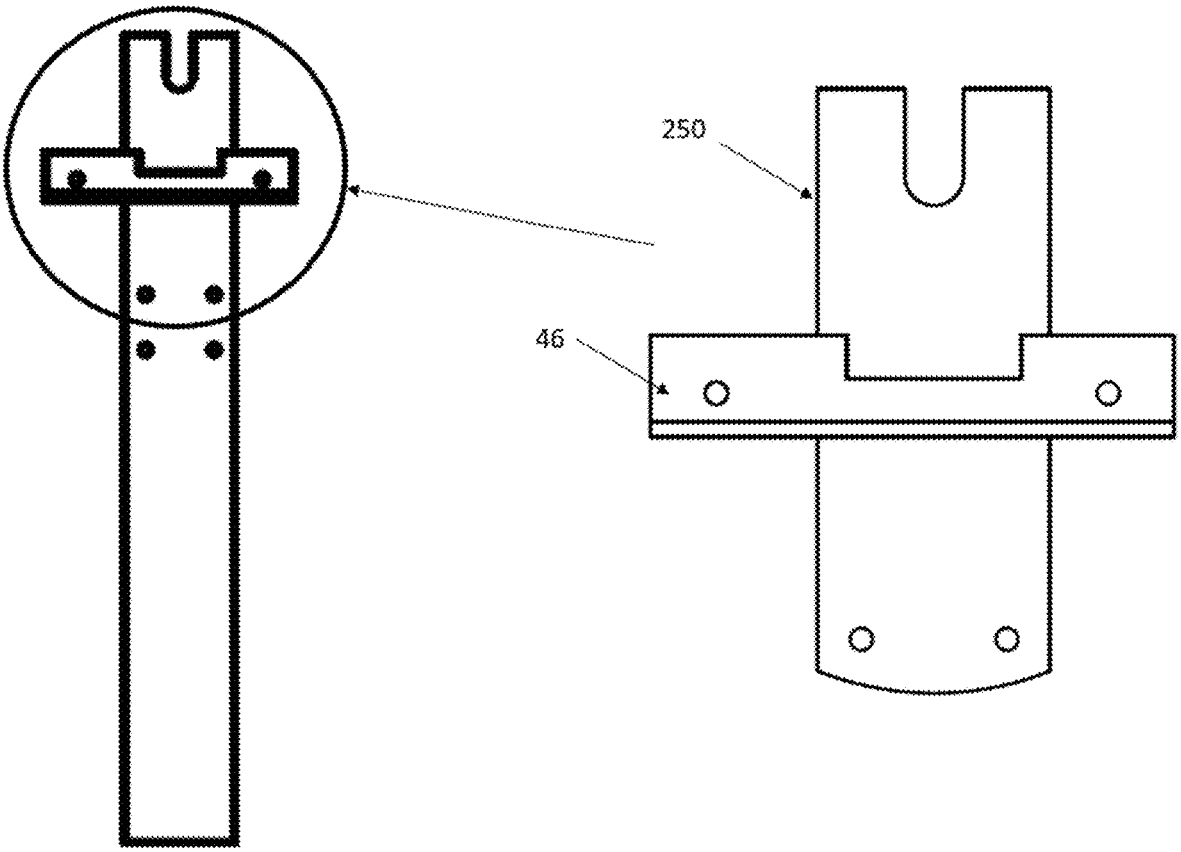
Figure 5C:
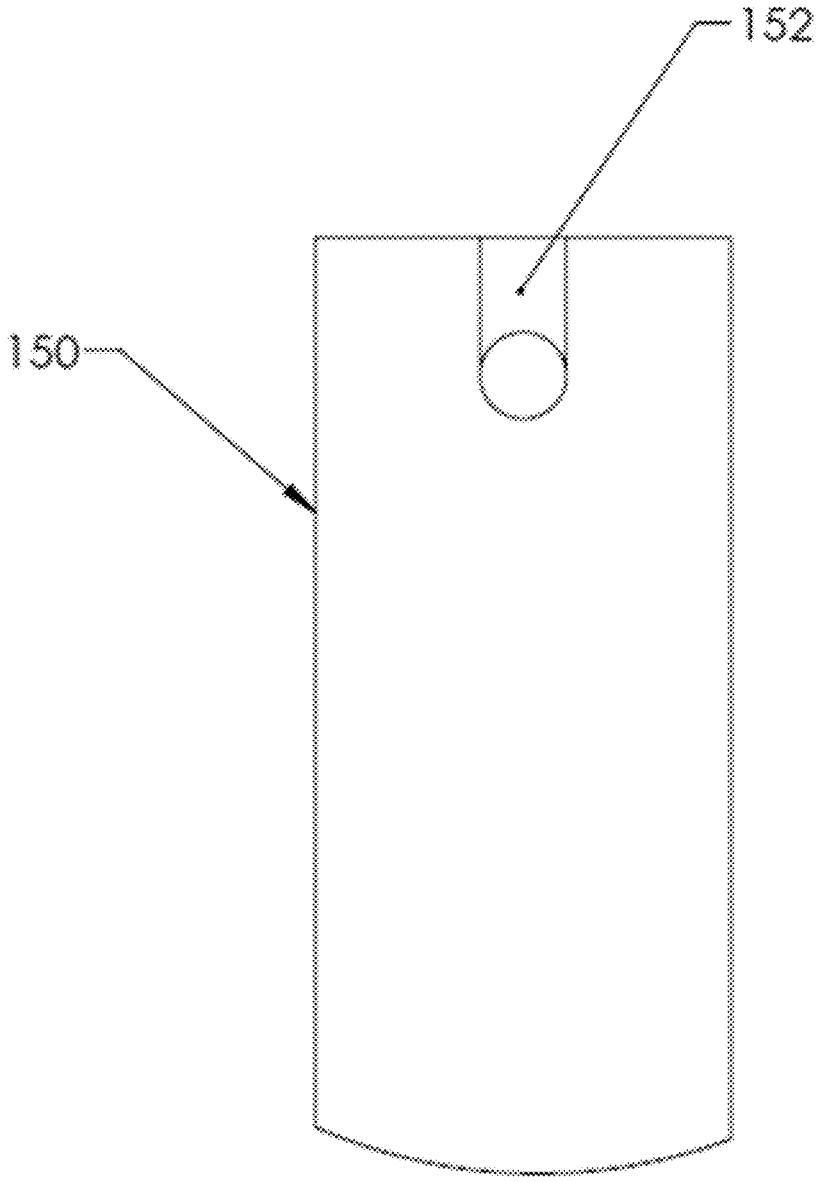
Figure 6:
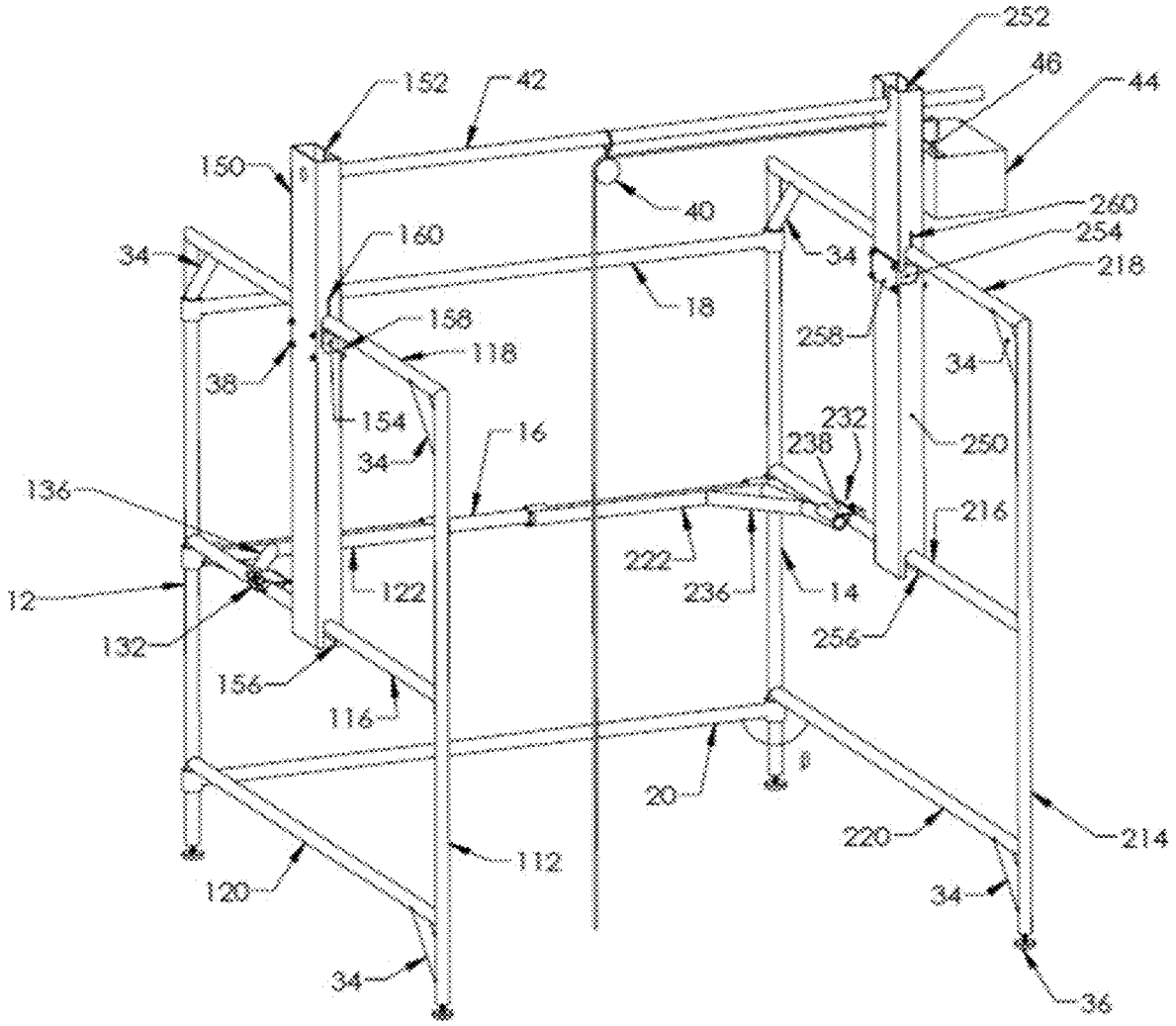
FIG. 6: Perspective view of a manhole guard with a hoist assembly and a winch attached to a winch platform in accordance with the present disclosure.

Referring now to FIGS. 5-6, some embodiments of the manhole guard 2 may include a first hoist assembly. The first hoist assembly comprises mounting brackets 150, 250 designed to facilitate the use of a first hoist device 40. For reference, these embodiments are referred to as first hoist assembly configurations of the manhole guard 2. The mounting brackets 150, 250 are typically hollow to reduce weight. This ensures the mounting brackets 150, 250 are easily portable, durable, and simple to assemble with tools commonly held on-site. However, non-hollow mounting brackets 150, 250 are encompassed within the present disclosure.

The first hoist assembly generally includes a first mounting bracket 150 and a second mounting bracket 250. The first mounting bracket 150 is connected to the first wing 100, and the second mounting bracket 250 is connected to the second wing 200. The first mounting bracket 150 has a first top recess 152, a first middle recess 154, and a first lower recess 156. The first lower recess 156 is of a size, shape, and location so as to be capable of accepting one of the first wing rails 116, 118, 120 in an interference fit. In particular embodiments, the first lower recess 156 accepts the first middle wing rail 116 in an interference fit. The first middle recess 154 is of a size, shape, and location so as to be capable of accepting the first upper wing rail 118. The first middle recess 154 can be secured to the first upper wing rail 118 by at least one first mounting plate 158 which connects to the first mounting bracket 150 with one or more bolts 38. The first top recess 152 is of a size, shape, and location so as to be capable of accepting a first crossbar 42 of any desired diameter.

As seen in FIGS. 5-6, the second mounting bracket 250 has a second top recess 252, a second middle recess 254, and a second lower recess 256. The second lower recess 256 is of a size, shape, and location so as to be capable of accepting one of the second wing rails 216, 218, 220 in an interference fit. In particular embodiments, the second lower recess 256 accepts the second middle wing rail 216 in an interference fit. The second middle recess 254 is of a shape, size, and location so as to be capable of accepting the second upper wing rail 218. The second middle recess 254 can be secured to the second upper wing rail 218 by at least one second mounting plate 258 which connects to the second mounting bracket 250 with one or more bolts 38. The second top recess 252 is of a size, shape, and location so as to be capable of accepting a first crossbar 42 of any desired diameter.

In one particular embodiment, the first mounting bracket 150 and the second mounting bracket 250 each have an "L" shaped middle recess 154, 254. This "L" configuration allows the middle recess 154, 254 to horizontally accept an upper wing rail 118, 218 such that the mounting bracket 150, 250 can be lowered onto the upper wing rail 118, 218, causing the upper wing rail 118, 218 to be vertically displaced in the middle recess 154, 254 of the mounting bracket 150, 250. Once lowered, the mounting bracket 150, 250 sits directly on the upper wing rail 118, 218 in an interference fit, and the mounting bracket 150, 250 sits directly on the lower wing rail 116, 216 in an interference fit. This beneficial method of attaching the mounting brackets 150, 250 ensures that each mounting bracket 150, 250 can only be freed from the wing rails 116, 118, 216, 218 by applying upward force to the mounting bracket 150, 250. Any downward force applied to the mounting bracket 150, 250, such as during weighted operation of a hoist 40, solidifies the attachment of the mounting bracket 150, 250 to the wing rails 116, 118, 216, 218.

As seen in FIGS. 1, 5A, and 6, first slits 160 are present at the top of the middle recess 154 of the first mounting bracket 150, on opposing sides thereof. Similarly, second slits 260 are present at the top of the middle recess 254 of the second mounting bracket 250, on opposing sides thereof. The presence of the slits 160, 260 allows for the tightening of the middle recess 154, 254 around the circumference of the upper wing rail 118, 218 so as to create a secure interference fit. The slits 160, 260 are elongated and extend from the top of the middle recess 154, 254. When the bolts 38 securing the mounting plates 158, 258 to the mounting brackets 150, 250 are tightened, the slits 160, 260 permit the middle recesses 154, 254 to deform and pinch inward so as to form-fit the upper wing rails 118, 218.

The first crossbar 42, when present, extends from the first top recess 152 of the first mounting bracket 150 to the second top recess 252 of the second mounting bracket 250. In some embodiments, as depicted in FIG. 5A, the top recesses 152, 252 are uncovered and designed to accept half of the circumference of the first crossbar 42, with the other half of the circumference of the first crossbar 42 protruding atop the top recesses 152, 252. This permits quick assembly and removal of the first crossbar 42. In other embodiments, as depicted in FIG. 5B, at least one top recess 152, 252 is partly covered and designed to accept the entire circumference of the first crossbar 42. In this configuration, the first crossbar 42 extends through the recess 152, 252 which, as a whole, reduces wiggle and provides greater stability of the first crossbar 42. In the embodiments depicted in FIG. 1 and FIG. 6, the first mounting bracket 150 has a partly covered top recess 152, and the second mounting bracket 250 has an uncovered top recess 252. In yet other configurations, both top recesses 152, 252 are partly or fully covered and designed to accept the full circumference of the first crossbar 42. When in use with a manhole guard 2 arranged around a manhole, the first crossbar 42 extends over the open manhole. The first crossbar 42 can suspend a first hoist device 40 over the manhole, the first hoist device 40 being capable of transporting materials or people through the manhole between the surface and subsurface.

As depicted in FIG. 6, the first crossbar 42 penetrates the first top recess 152 and the second top recess 252. This configuration helps keep the first crossbar 42 in position in the top recesses 152, 252 of the mounting brackets 150, 250. In addition, the first top recess 152 and the second top recess 252 serve to distribute the force of the first crossbar 42 throughout the manhole guard 2 during weighted operation of the first hoist device 40.

As seen in FIGS. 5A-5B, the first and second mounting plates 158, 258 ensure that the first mounting bracket 150 and the second mounting bracket 250 stay fastened to the first wing rails 116, 118 and the second wing rails 216, 218, respectively, with little wiggle or movement. Furthermore, attachment of the mounting brackets 150, 250 to multiple wing rails provides the benefit of evenly distributing force during weighted operation of the first hoist device 40.

As shown in FIG. 5A, certain embodiments of the manhole guard 2 further include a first winch platform 46. The first winch platform 46 can be connected to either or both mounting brackets 150, 250, on either the inner side of the mounting bracket (i.e., the side facing the manhole when the first arm 122 and second arm 222 are locking the first wing 100 and second wing 200 in a fixed position relative to the center section 10) or the outer side of the mounting bracket. A first winch 44 can be attached to the first winch platform 46 and can be used to operate the first hoist device 40. Any suitable winch can be utilized with the manhole guard 2 of the present disclosure.

Referring now to FIGS. 7-17, some embodiments of the manhole guard 2 may include a second hoist assembly 78. The second hoist assembly 78 may include mounting members 310, 410 configured to facilitate the use of a second hoist device 70. The second hoist assembly 78 can be used independent of the first hoist assembly 48 or it can be used simultaneously with the first hoist assembly 48. For reference, these embodiments are referred to as second hoist assembly 78 configurations of the manhole guard 2.

Figure 9:
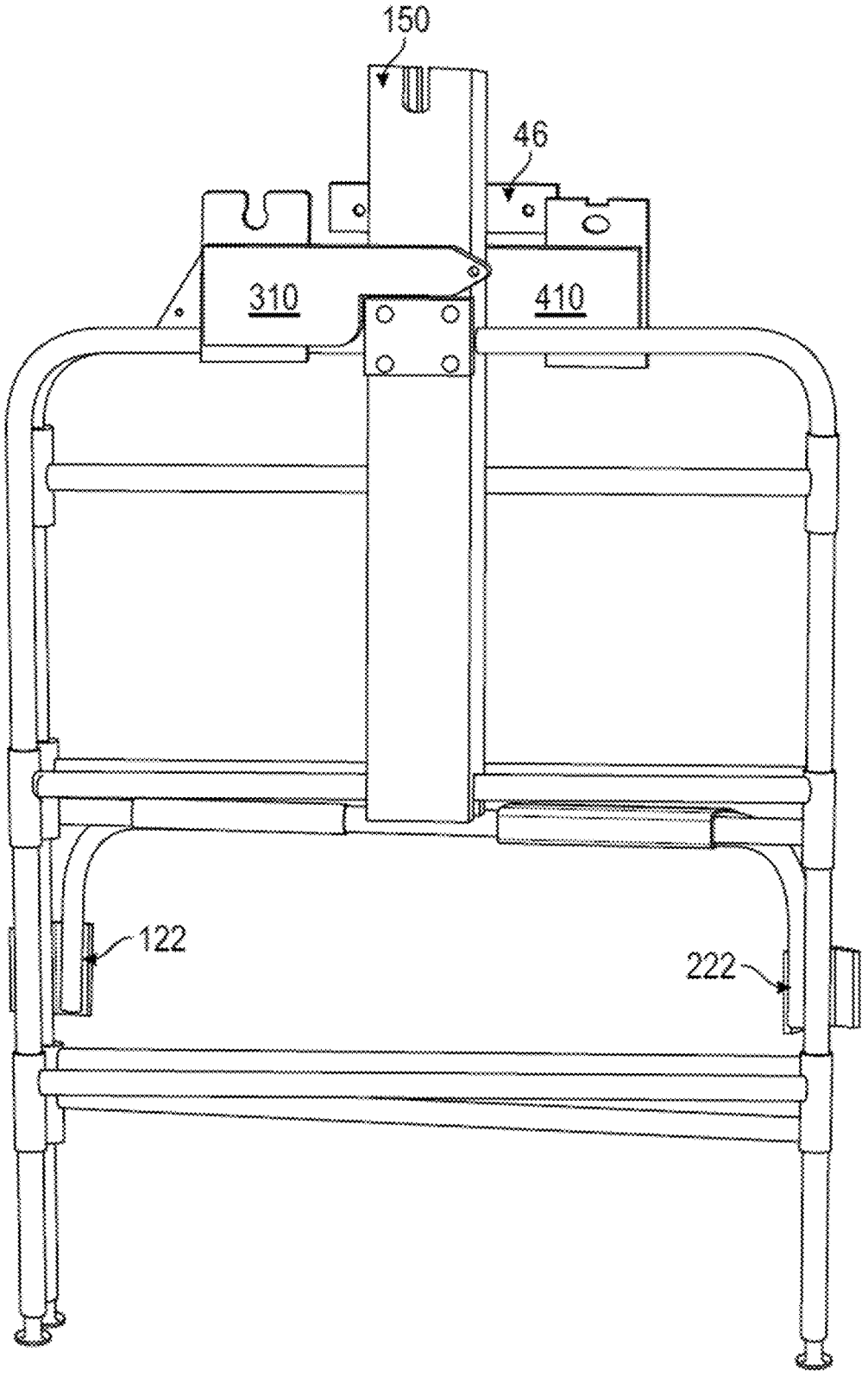
FIG. 9: Photograph showing a side view of the manhole guard in a folded position with attached mounting brackets and mounting members.
Figure 10A:
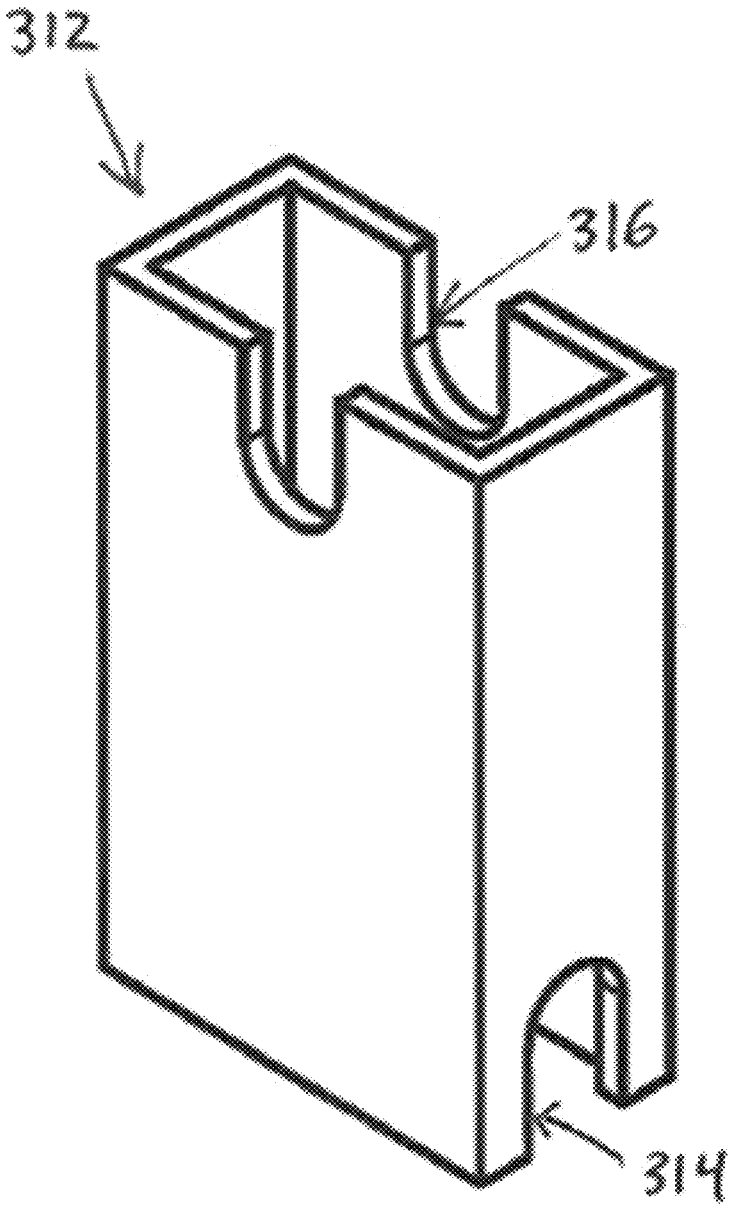
FIGS. 10A-10D: Views of the primary body of the primary mounting member.
Figure 10B:
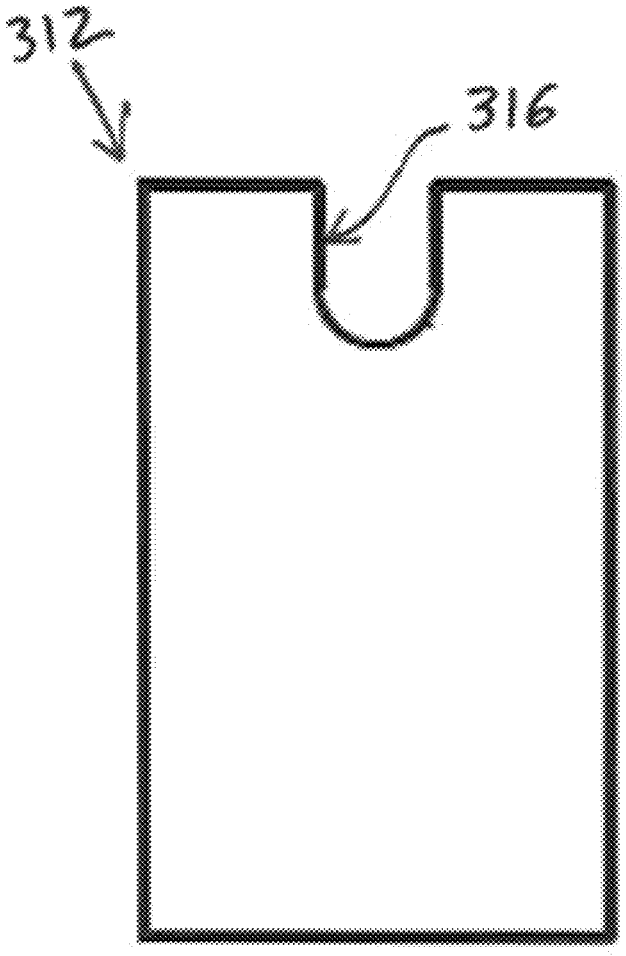
Figure 10C:
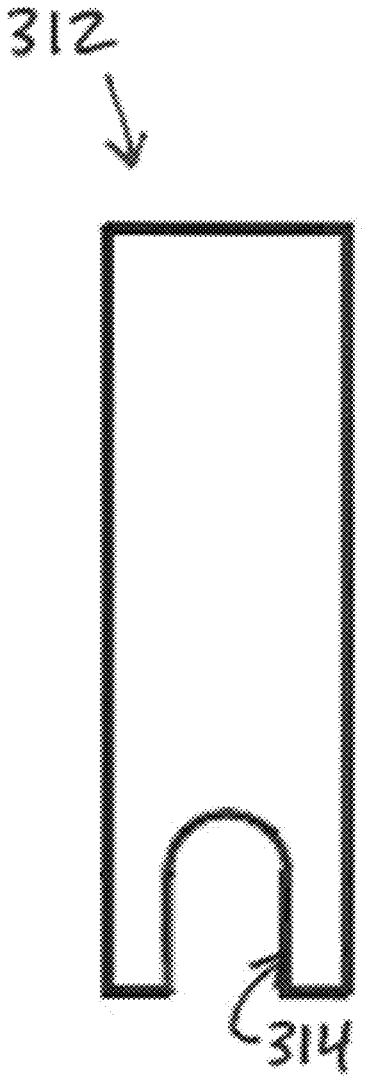
Figure 10D:
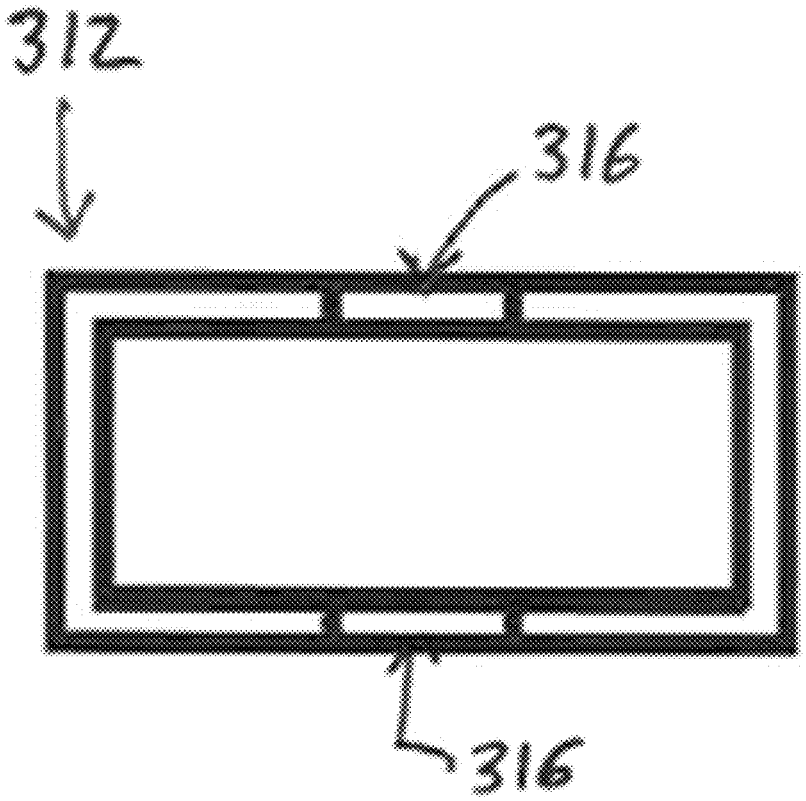
Figure 11A:
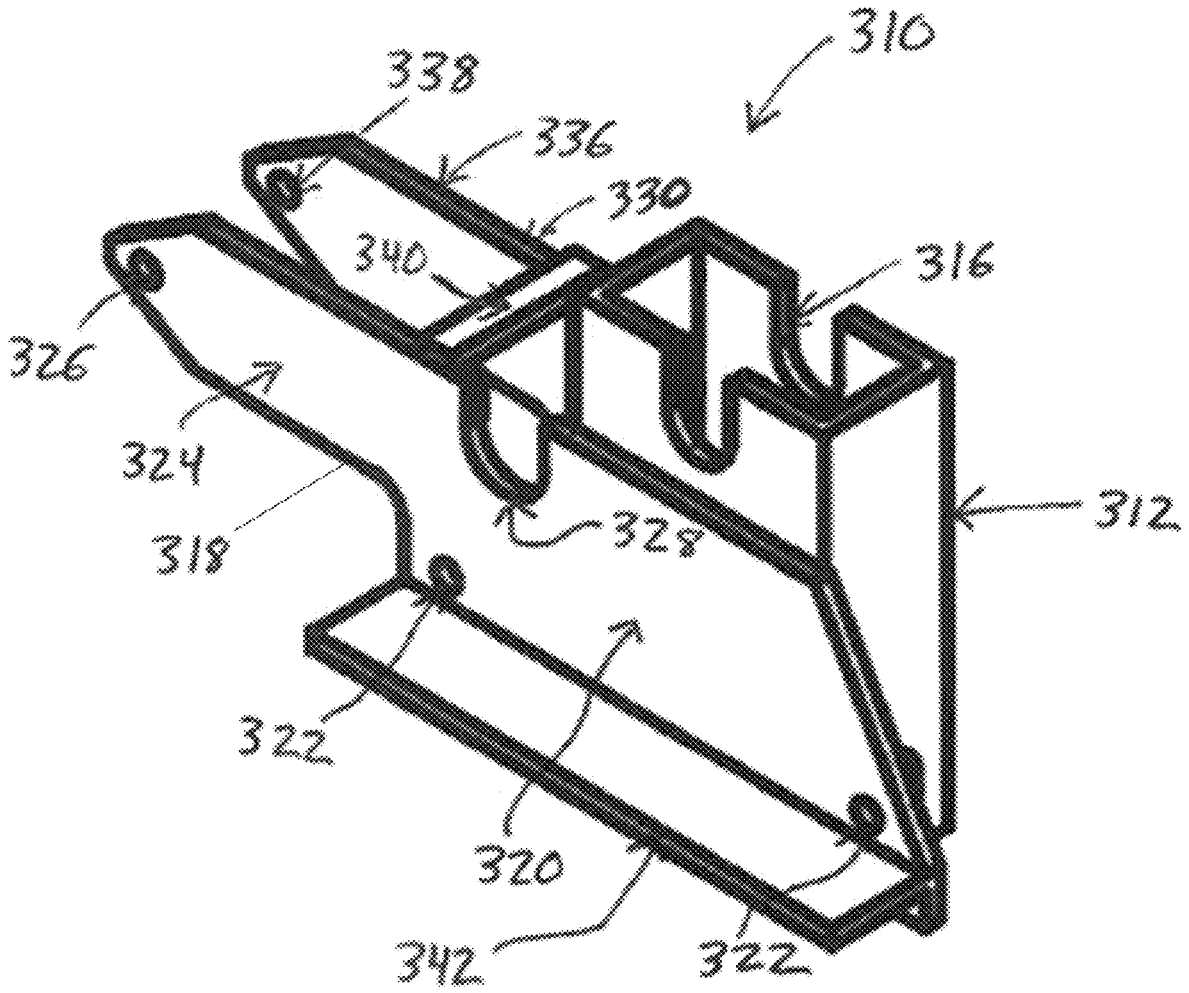
FIGS. 11A-11D: Views of the primary mounting member.
Figure 11B:
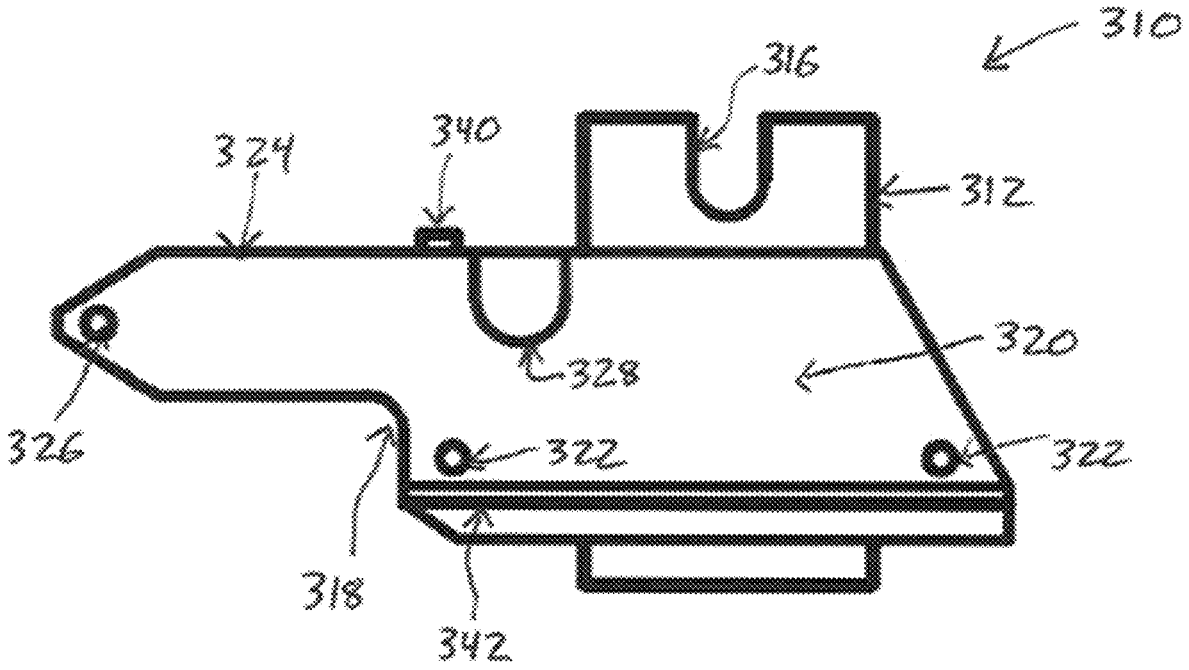
Figure 11C:
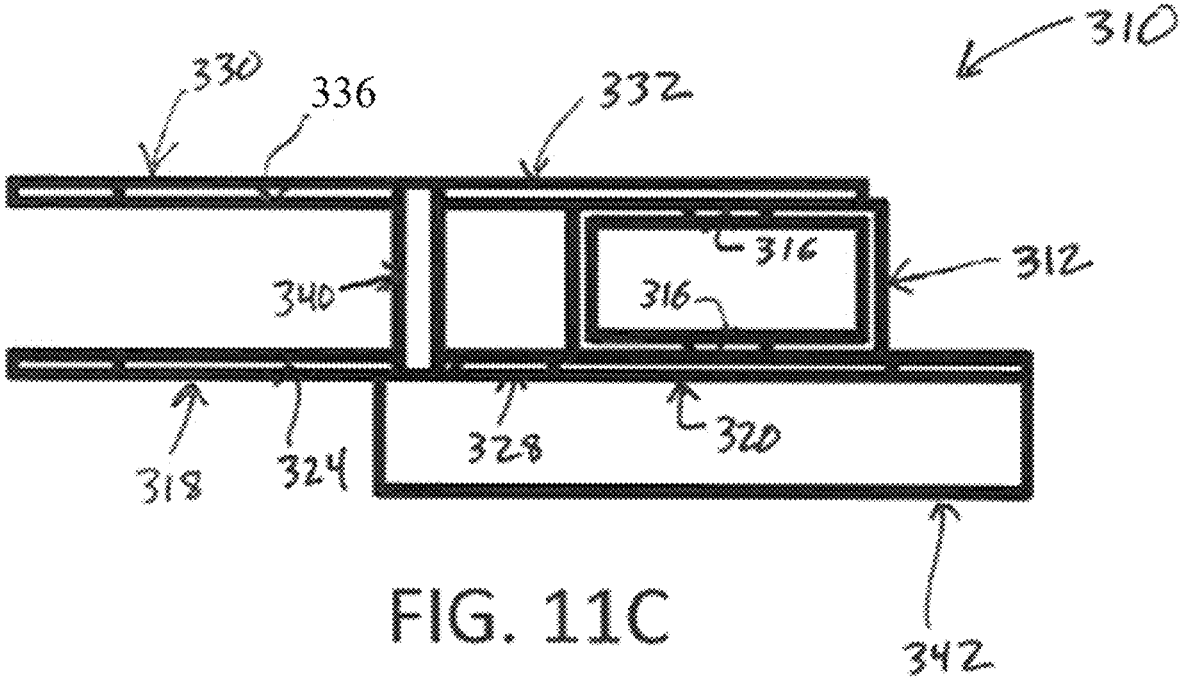
Figure 11D:
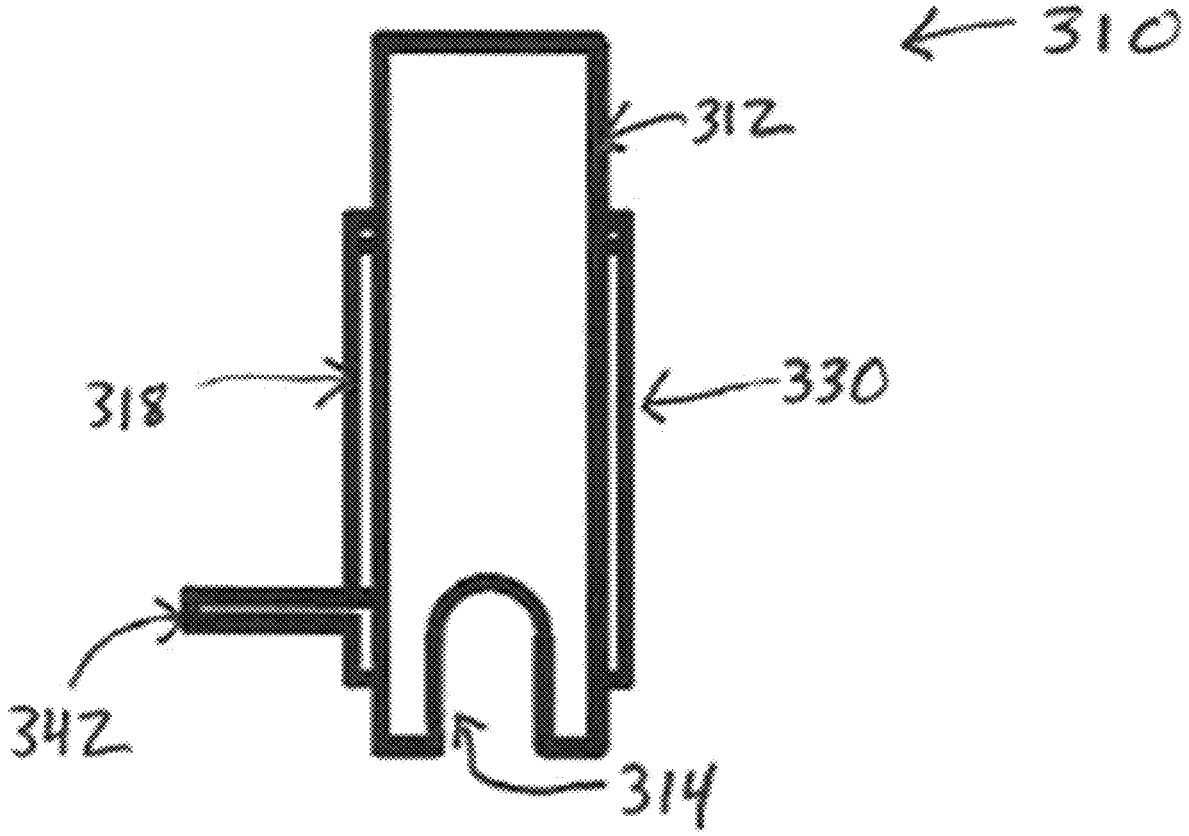

The second hoist assembly 78 may generally include a primary mounting member 310 and a secondary mounting member 410. The primary mounting member 310 is connected to the first wing 100 and to the first mounting bracket 150, and the secondary mounting member 410 is connected to the second wing 200 and to the second mounting bracket 250, in a manner that will be described in more detail below. The manhole guard 2 is still capable of folding relatively flat when the primary mounting member 310 is connected to the first wing 100 and to the first mounting bracket 150, and the secondary mounting member 410 is connected to the second wing 200 and to the second mounting bracket 250, as shown in FIG. 9.

Figure 12:
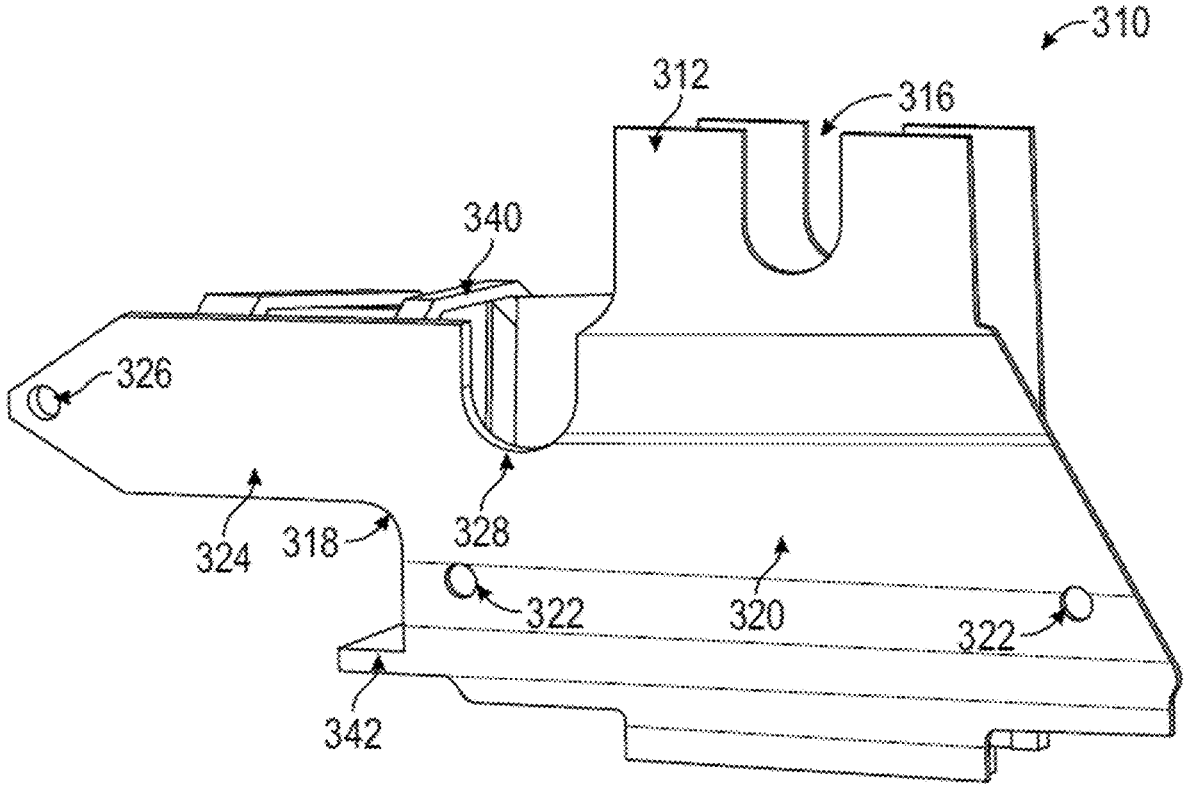
FIG. 12: Photograph showing a side view of a primary mounting member that includes a first primary arm recess, a primary body upper recess, a primary bridging member, and a winch platform.
Figure 13A:
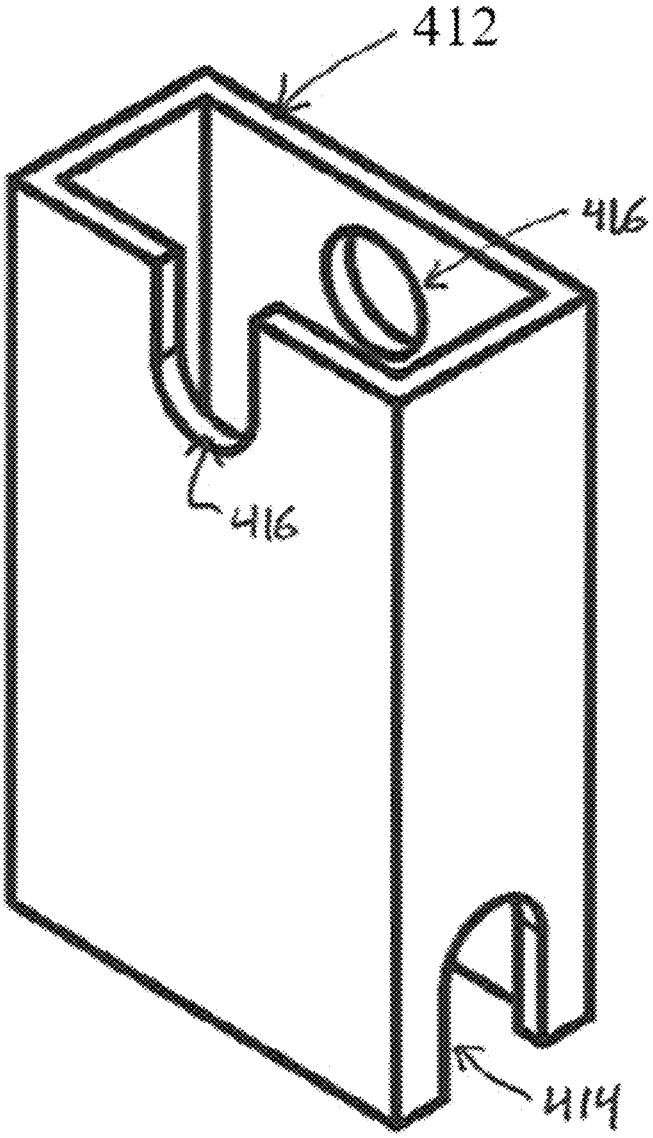
FIGS. 13A-13D: Views of the secondary body of the secondary mounting member.
Figure 13B:
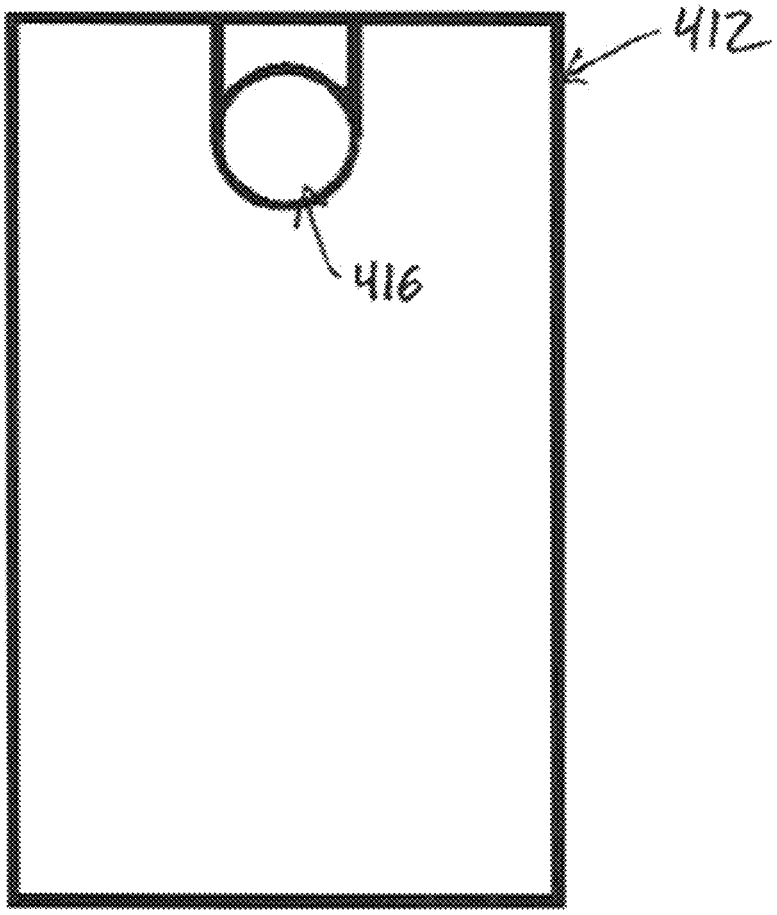
Figure 13C:
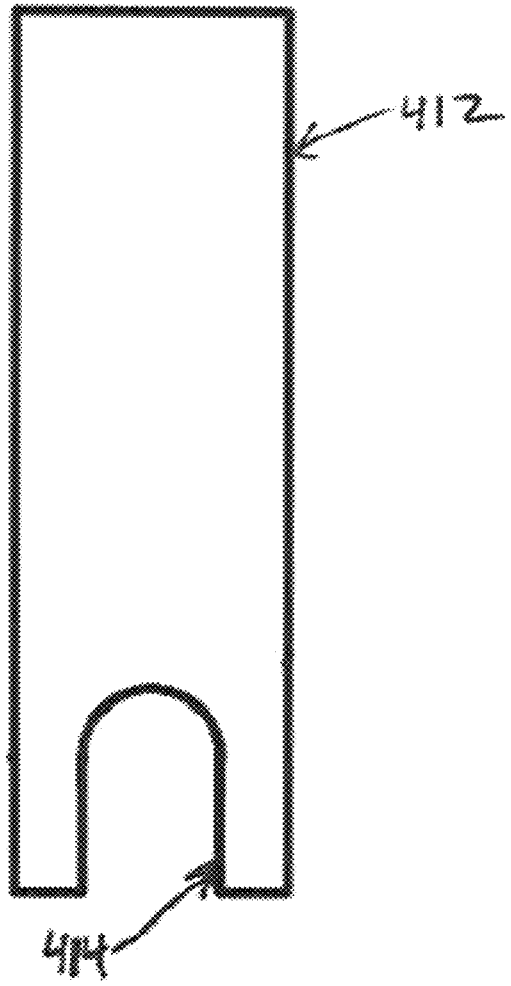
Figure 13D:
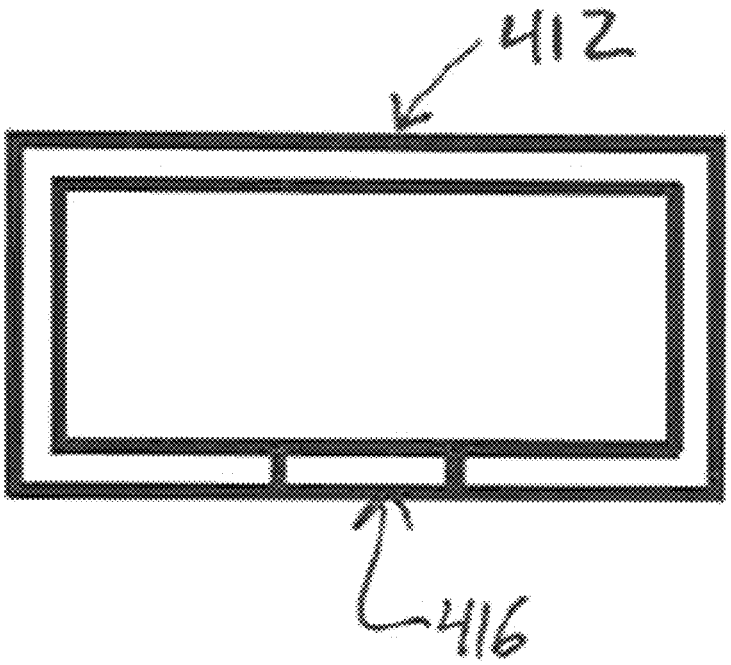
Figure 14A:
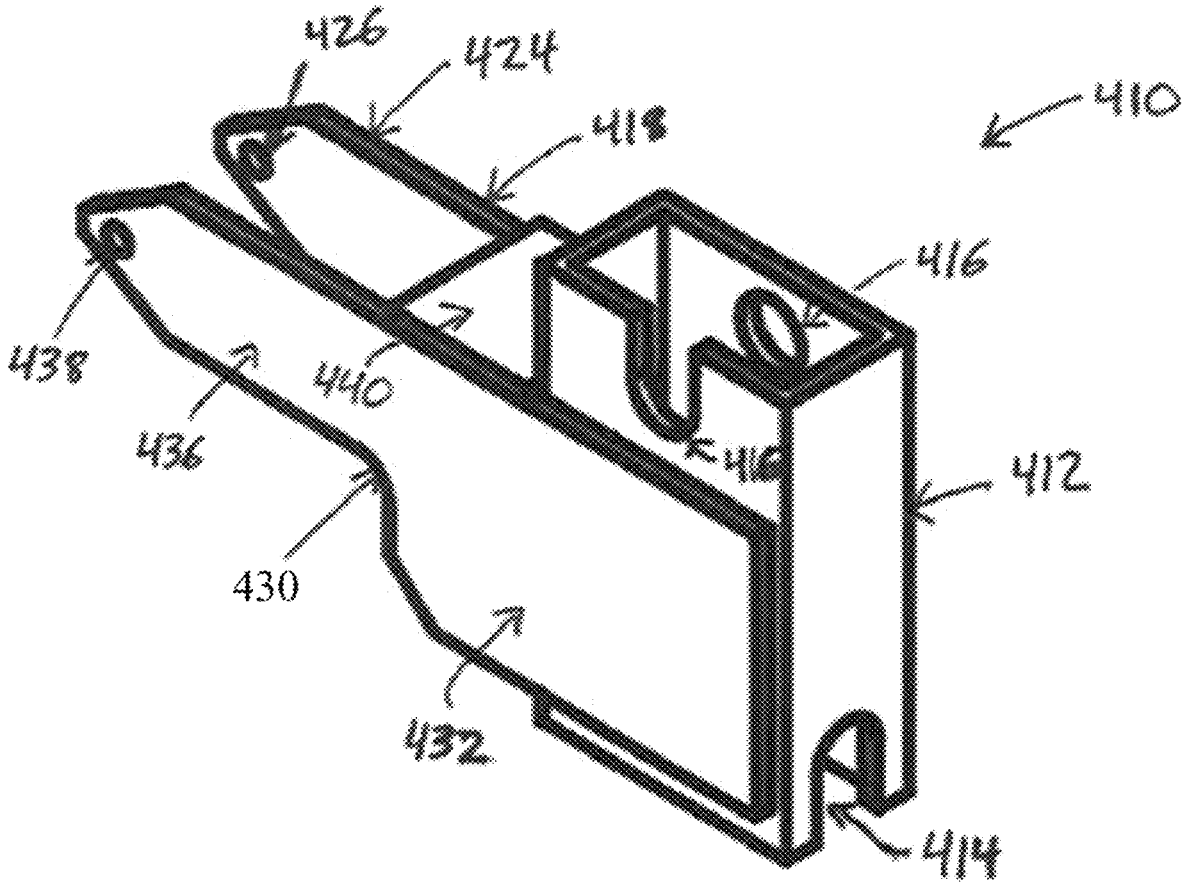
FIGS. 14A-14D: Views of the secondary mounting member.
Figure 14B:
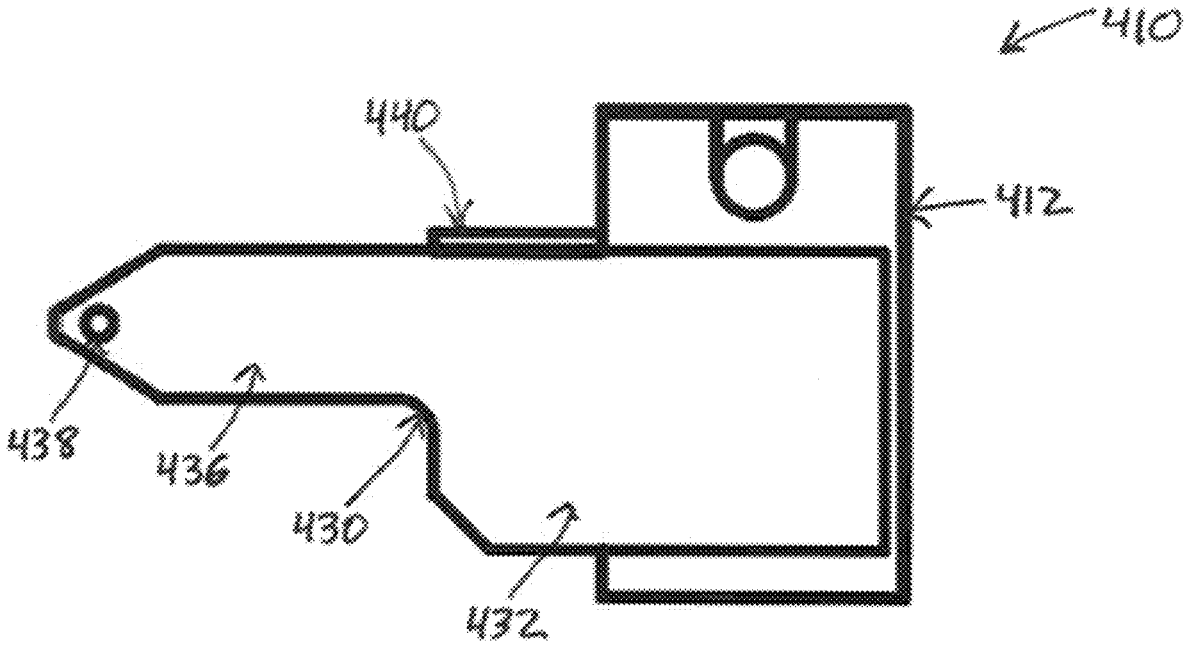
Figure 14C:
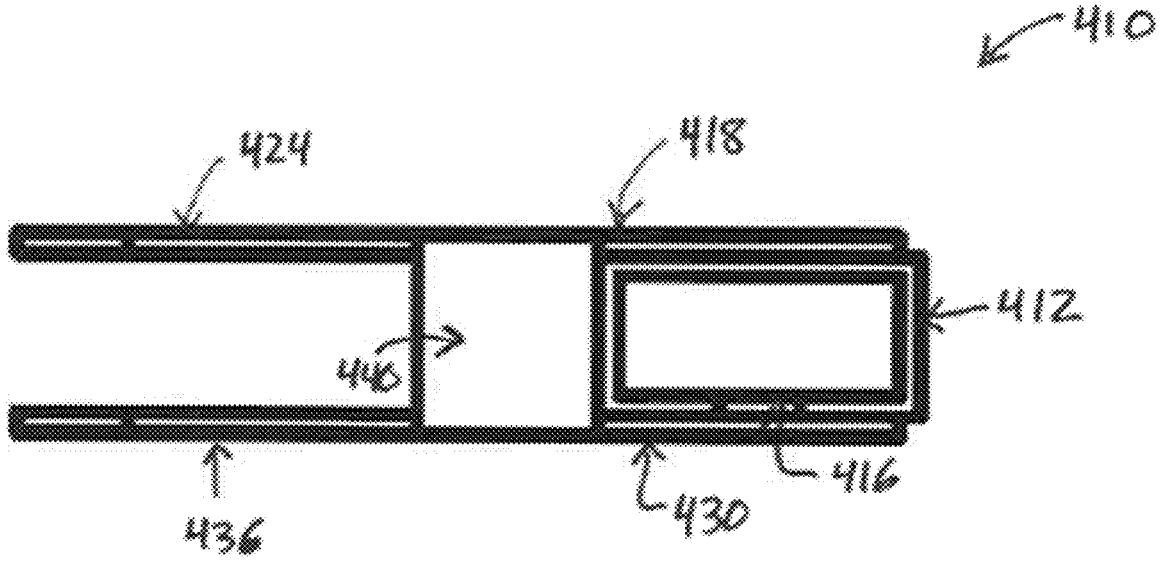
Figure 14D:
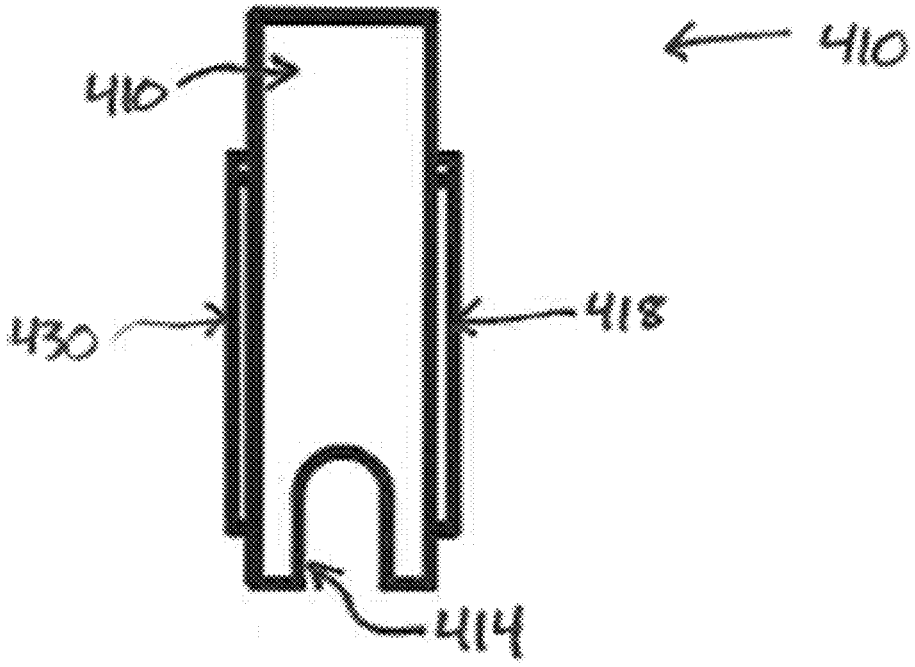

Referring now to FIGS. 10-12, the primary mounting member 310 may include a primary body 312 having a primary body lower recess 314 and a primary body upper recess 316. The primary body lower recess 314 is of a size, shape, and location so as to be capable of accepting one of the first wing rails 116, 118 in an interference fit. In particular embodiments, the primary body lower recess 314 accepts the first upper wing rail 118 in an interference fit. The primary body upper recess 316 is of a size, shape, and location so as to be capable of accepting a second crossbar 72 of any desired diameter.

The primary body lower recess 314 may be positioned on the primary body 312 at an angle relative to the position of the primary body upper recess 316 on the primary body 312. In some embodiments, the primary body lower recess 314 extends through the primary body 312 in a direction that is transverse to the direction the primary body upper recess 316 extends through the primary body 312.

The primary body 312 can be a variety of shapes and sizes. The primary body 312 typically has a hollow structure to reduce weight. This ensures the mounting members 310, 410 are easily portable, durable, and simple to assemble with tools commonly held on-site. However, a non-hollow primary body is encompassed within the scope of the present disclosure. In the embodiment illustrated in FIGS. 10-12, the primary body 312 has a hollow rectangular structure with the primary body lower recess 314 and the primary body upper recess 316 located at opposing ends of the primary body 312. In these embodiments, the primary body lower recess 314 extends through the primary body 312 in a direction that is transverse to the direction the primary body upper recess 316 extends through the primary body 312.

Referring now to FIGS. 11-12, the primary mounting member 310 may also include one or more arms 318, 330 connected to the primary body 312 for the purpose of securing the primary mounting member 310 to the first mounting bracket 150. In the embodiments shown in FIGS. 11-12, the primary mounting member 310 includes a first primary arm 318 and a second primary arm 330 connected to opposing sides of the primary body 312 in a manner so as not to obstruct access to the primary body lower recess 314 and the primary body upper recess 316.

The first primary arm 318 can be a variety of shapes and sizes. In the embodiments depicted in FIGS. 11-12, the first primary arm 318 has a general shape that may resemble a meat cleaver, and includes a first primary arm recess 328. The first primary arm 318 may include a first primary arm body 320 and a first primary arm extension 324 extending from the first primary arm body 320. The first primary arm body 320 may include at least one first primary arm body opening 322 for a purpose that will be described below. The first primary arm extension 324 may include a first primary arm extension opening 326 for a purpose that will be described below. The first primary arm extension 324 may have a tapered end. However, a non-tapered first primary arm extension 324 is encompassed within the scope of the present disclosure.

The second primary arm 330 can be a variety of shapes and sizes. Generally, the second primary arm 330 has a size and shape similar to the first primary arm 318 to facilitate cooperation between the first primary arm 318 and the second primary arm 330 in order to secure the primary mounting member 310 to the first mounting bracket 150. In the embodiments depicted in FIGS. 11-12, the second primary arm 330 has a general shape that resembles a meat cleaver, similar to the first primary arm 318. The second primary arm 330 may include a second primary arm body 332 and a second primary arm extension 336 extending from the second primary arm body 332. The second primary arm body 332 may include at least one second primary arm body opening for a purpose that will be described below. The second primary arm extension 336 may include a second primary arm extension opening 338 for a purpose that will be described below. The second primary arm extension 336 may have a tapered end. However, a non-tapered second primary arm extension 336 is encompassed within the scope of the present disclosure. When the first primary arm 318 and second primary arm 330 are connected to the primary body 312, the first primary arm extension 324 and the second primary arm extension 336 extend in the same direction such that the first primary arm extension opening 326 is aligned with the second primary arm extension opening 338 to receive a fastener.

As depicted in FIGS. 11-12, the primary mounting member 310 may also include a primary bridging member 340. The primary bridging member 340 may be a piece of metal extending between the first primary arm 318 and the second primary arm 330, connected to the first primary arm 318 at one end of the primary bridging member 340 and connected to the second primary arm 330 at a second end of the primary bridging member 340. As best shown in FIGS. 11-12, the primary bridging member 340 is connected between the first primary arm 318 and second primary arm 330 of the primary mounting member 310 at a location on the primary mounting member 310 that positions the first primary arm recess 328 between the primary bridging member 340 and the primary body 312.

As shown in FIGS. 11-12, the primary mounting member 310 also includes a second winch platform 342 for the manhole guard 2. The second winch platform 342 may be attached to the first primary arm 318, the primary body 312, or both the first primary arm 318 and the primary body 312. In the embodiments shown in FIGS. 11A-11D, the second winch platform 342 has a structure comprising an "L" shape and is attached to both the first primary arm 318 and the primary body 312.

As best shown in FIGS. 7-9 and 16, the primary mounting member 310 may be connected to the first upper wing rail 118 of the first wing 100 and to the first mounting bracket 150. The primary mounting member 310 may be fixed to the first mounting bracket 150 through the use of proper positioning and a fastener. Specifically, the first mounting bracket 150 may be positioned between the primary bridging member 340 and the first and second primary arm extension openings 326, 338. Then, a fastener, such as a bolt or a pin-clip assembly, may be extended through the first and second primary arm extension openings 326, 328 to secure the primary mounting member 310 to the first mounting bracket 150.

Figure 15:
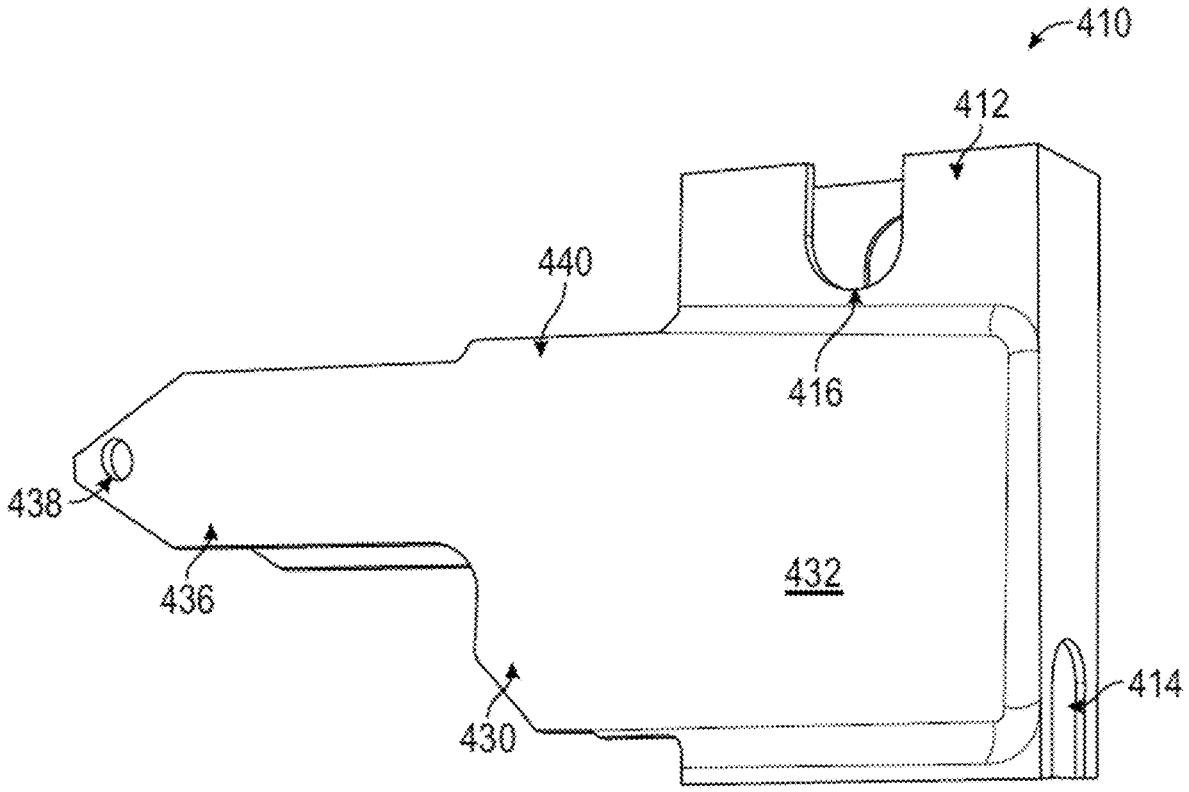
FIG. 15: Photograph showing a side view of a secondary mounting member that includes a secondary body upper recess and a secondary bridging member.

Referring now to FIGS. 13-15, the secondary mounting member 410 may include a secondary body 412 having a secondary body lower recess 414 and a secondary body upper recess 416. The secondary body lower recess 414 is of a size, shape, and location so as to be capable of accepting one of the second wing rails 216, 218 in an interference fit. In particular embodiments, the secondary body lower recess 414 accepts the second upper wing rail 218 in an interference fit. The secondary body upper recess 416 is of a size, shape, and location so as to be capable of accepting a second crossbar 72 of any desired diameter.

The secondary body lower recess 414 may be positioned on the secondary body 412 at an angle relative to the position of the secondary body upper recess 416 on the secondary body 412. In some embodiments, the secondary body lower recess 414 extends through the secondary body 412 in a direction that is transverse to the direction the secondary body upper recess 416 extends through the secondary body 412.

The secondary body 412 can be a variety of shapes and sizes. The secondary body 412 typically has a hollow structure to reduce weight. This ensures the mounting members 310, 410 are easily portable, durable, and simple to assemble with tools commonly held on-site. However, a non-hollow secondary body 412 is encompassed within the scope of the present disclosure. In the embodiments illustrated in FIGS. 13-15, the secondary body 412 has a hollow rectangular structure with the secondary body lower recess 414 and the secondary body upper recess 416 located at opposing ends of the secondary body 412. In these embodiments, the secondary body lower recess 414 extends through the secondary body 412 in a direction that is transverse to the direction the secondary body upper recess 416 extends through the secondary body 412.

Referring now to FIGS. 14-15, the secondary mounting member 410 also includes one or more secondary arms 418, 430 connected to the secondary body 412 for the purpose of securing the secondary mounting member 410 to the second mounting bracket 250. In the embodiments shown in FIGS. 14-15, the secondary mounting member 410 includes a first secondary arm 418 and a second secondary arm 430 connected to opposing sides of the secondary body 412 in a manner so as to not obstruct access to the secondary body lower recess 414 and the secondary body upper recess 416.

The first secondary arm 418 can have a variety of shapes and sizes. In the embodiments depicted in FIGS. 14-15, the first secondary arm 418 has a general shape that resembles a meat cleaver. The first secondary arm 418 comprises a first secondary arm body 420 and a first secondary arm extension 424 extending from the first secondary arm body 420. The first secondary arm extension 424 includes a first secondary arm extension opening 426 for a purpose that will be described below. The first secondary arm extension 424 may have a tapered end. However, a non-tapered first secondary arm extension 424 is encompassed within the scope of the present disclosure.

The second secondary arm 430 can be a variety of shapes and sizes. Generally, the second secondary arm 430 has a size and shape similar to the first secondary arm 418 to facilitate cooperation between the first secondary arm 418 and the second secondary arm 430 to secure the secondary mounting member 410 to the second mounting bracket 250. In the embodiments depicted in FIGS. 14-15, the second secondary arm 430 has a general shape that resembles a meat cleaver, similar to the first secondary arm 418. The second secondary arm 430 may include a second secondary arm body 432 and a second secondary arm extension 436 extending from the second secondary arm body 432. The second secondary arm extension 436 may include a second secondary arm extension opening 438 for a purpose that will be described below. The second secondary arm extension 436 may have a tapered end. However, a non-tapered second secondary arm extension 436 is encompassed within the scope of the present disclosure. When the first secondary arm 418 and second secondary arm 430 are connected to the secondary body 412, the first secondary arm extension 424 and the second secondary arm extension 436 extend in the same direction so that the first secondary arm extension opening 426 is aligned with the second secondary arm extension opening 438 to receive a fastener.

As depicted in FIGS. 14-15, the secondary mounting member 410 includes a secondary bridging member 440. The secondary bridging member 440 may be a piece of metal extending between the first secondary arm 418 and the second secondary arm 430, connected to the first secondary arm 418 at one end of the secondary bridging member 440 and connected to the second secondary arm 430 at a second end of the secondary bridging member 440.

As best illustrated in FIGS. 7-9 and 16, the secondary mounting member 410 may be connected to the second upper wing rail 218 of the second wing 200 and to the second mounting bracket 250. The secondary mounting member 410 may be fixed to the second mounting bracket 250 through the use of proper positioning and a fastener. Specifically, the second mounting bracket 250 may be positioned between the secondary bridging member 440 and the first and second secondary arm extension openings 426, 438. Then, a fastener, such as a bolt or a pin-clip assembly, may be extended through the first and second secondary arm extension openings 426, 438 to secure the secondary mounting member 410 to the second mounting bracket 250.

Figure 7A:
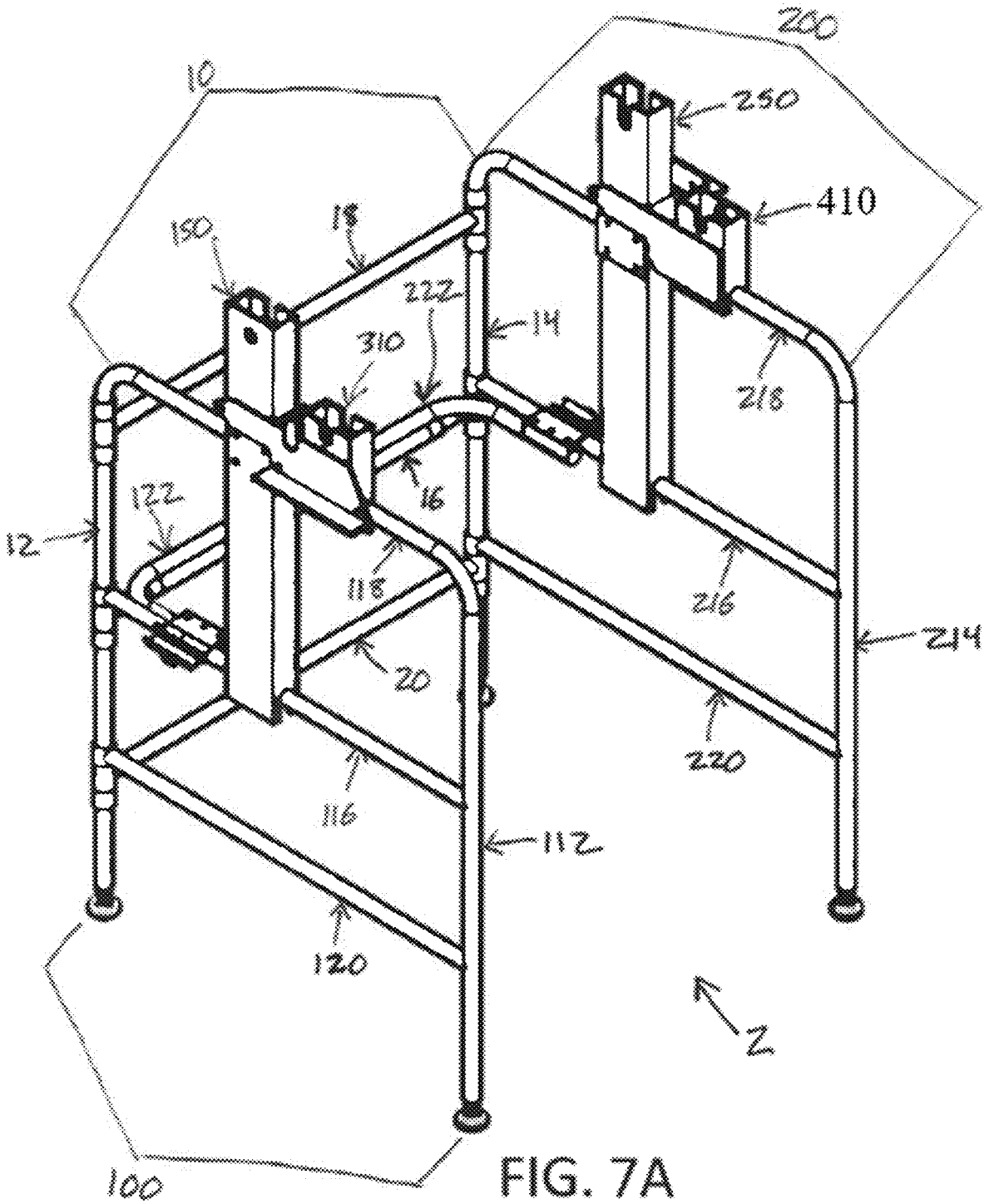
FIGS. 7A-7B: Views of a manhole guard with mounting brackets and mounting members.
Figure 7B:
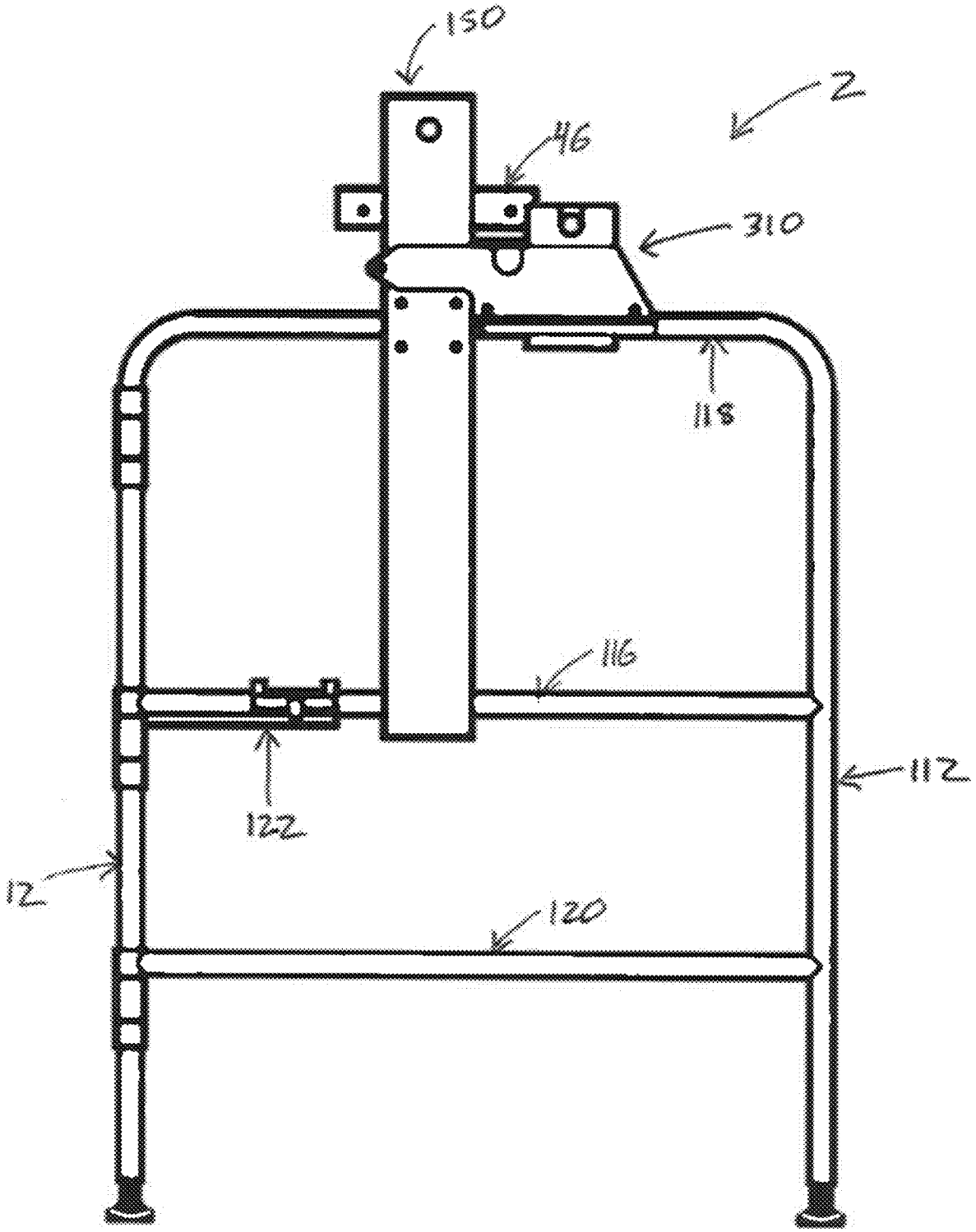
Figure 8:
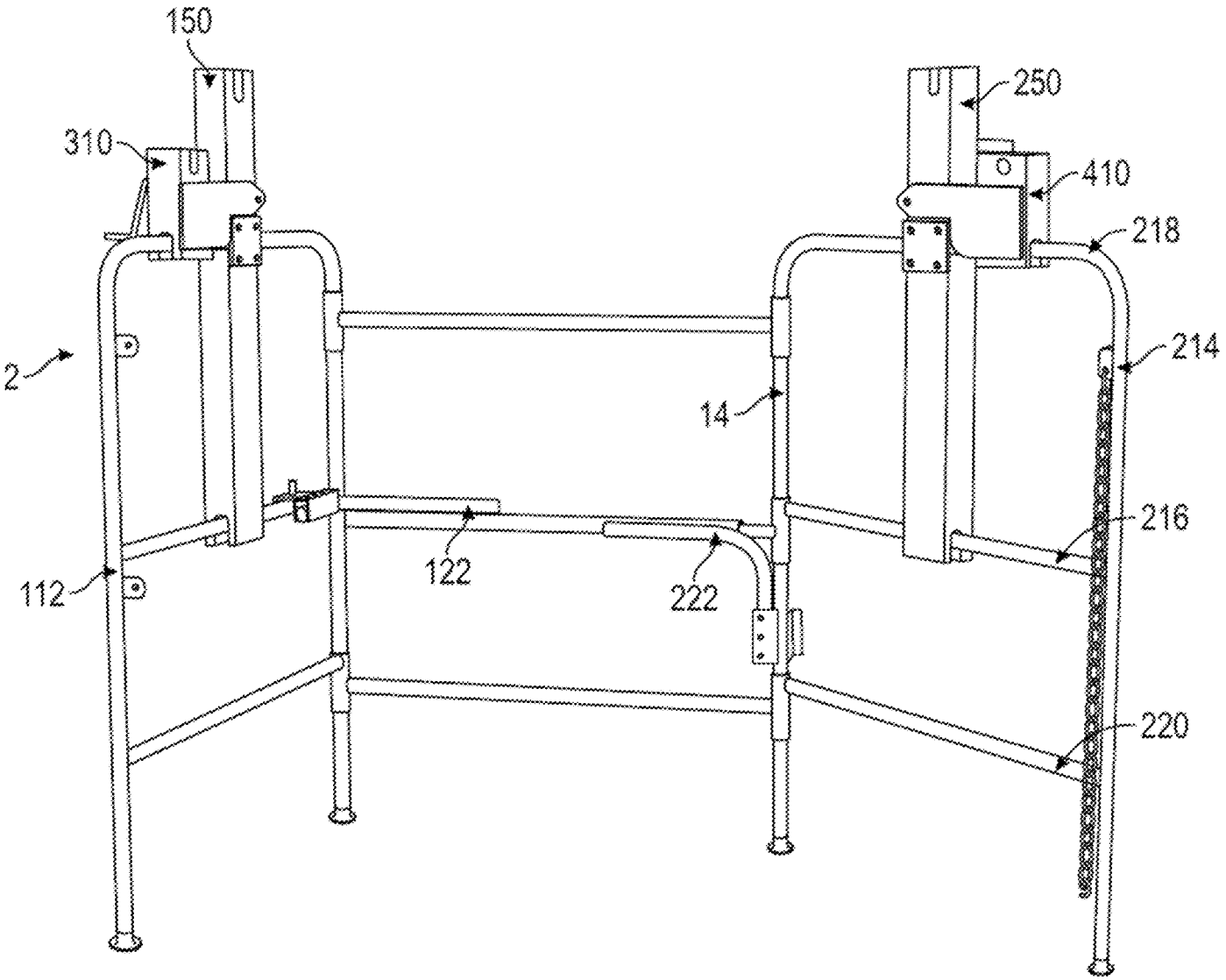
FIG. 8: Photograph showing a view of a manhole guard with attached mounting brackets and mounting members and a first arm securing the first wing into a fixed position.

The second crossbar 72, when present, extends from the primary body upper recess 316 of the primary mounting member 310 to the secondary body upper recess 416 of the secondary mounting member 410. In some embodiments, the primary body upper recess 316 and the secondary body upper recess 416 are uncovered and designed to accept half of the circumference of the second crossbar 72, with the other half of the circumference of the second crossbar 72 protruding atop the primary body upper recess 316 and the secondary body upper recess 416. This permits quick assembly and removal of the second crossbar 72. In other embodiments, as depicted in FIGS. 7A and 7B, at least one of the primary body upper recess 316 and the secondary body upper recess 416 is partly covered and designed to accept the entire circumference of the second crossbar 72. In this configuration, the second crossbar 72 extends through the secondary body upper recess 416 which, as a whole, reduces wiggle and provides greater stability of the second crossbar 72. In the embodiments depicted in FIGS. 7A and 7B, the secondary mounting member 410 has a partly covered secondary body upper recess 416 and the primary mounting member 310 has an uncovered primary body upper recess 316. In yet other configurations, both the primary body upper recess 316 and the secondary body upper recess 416 are partly or fully covered and designed to accept the full circumference of the second crossbar 72. When in use with a manhole guard 2 arranged around a manhole, the second crossbar 72 extends over the open manhole. The second crossbar 72 can suspend a second hoist device 70 over the manhole, the second hoist device 70 being capable of transporting materials or people through the manhole between the surface and subsurface.

Figure 16:
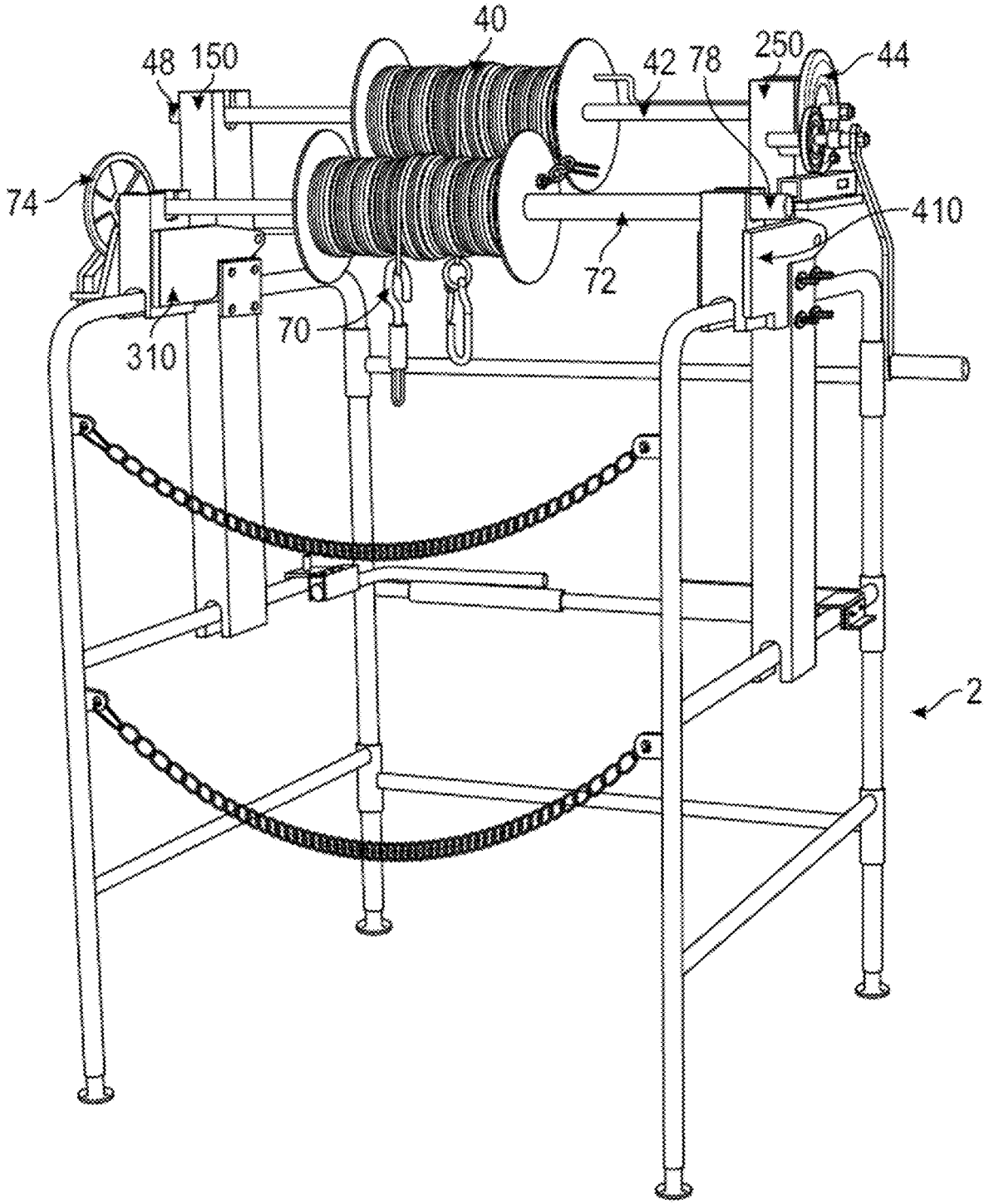
FIG. 16: Photograph of a manhole guard containing a fully assembled first hoist assembly and second hoist assembly.
Figure 17:
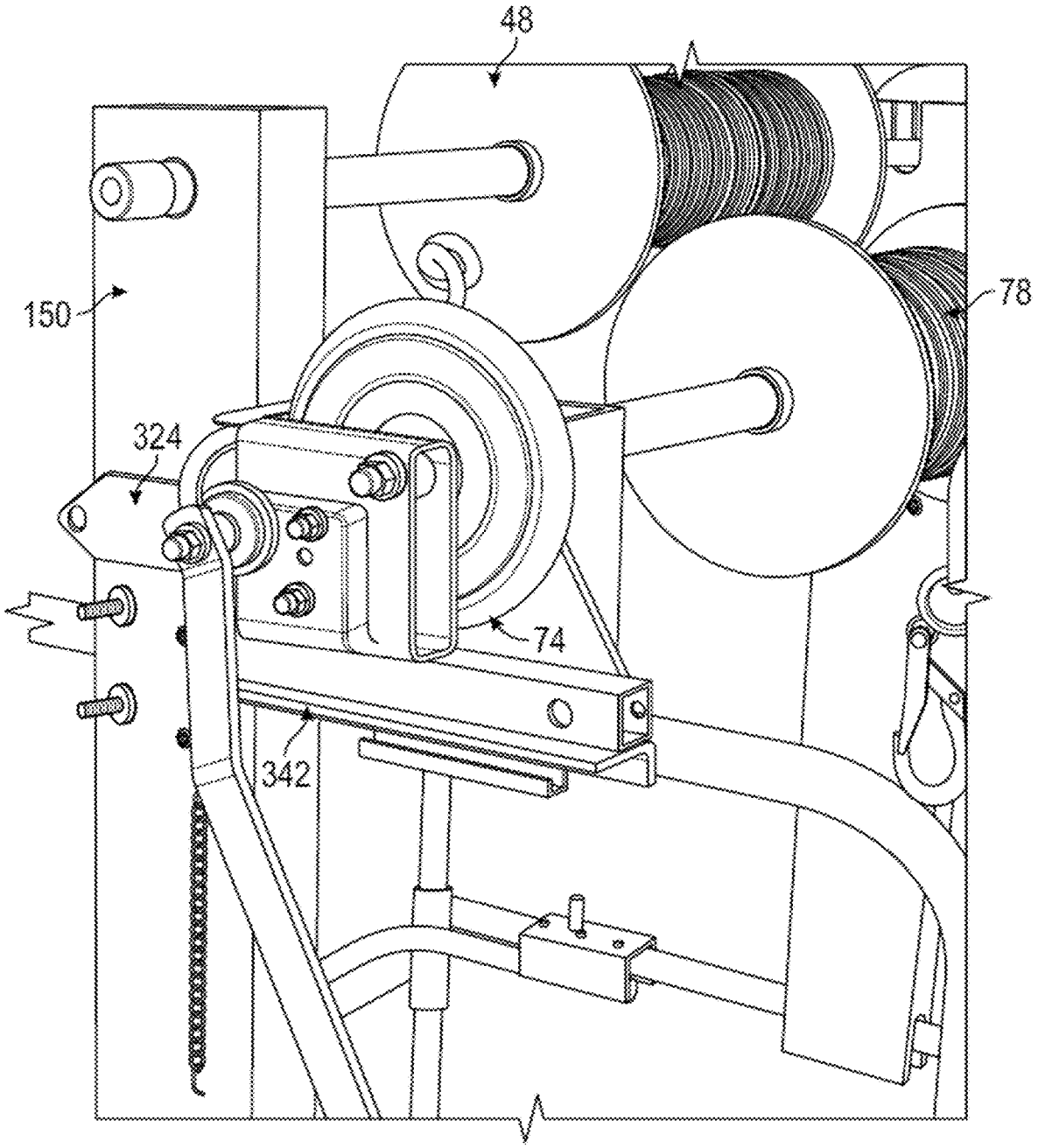
FIG. 17: Side view of the manhole guard from FIG. 16 from the first wing where a second winch is attached to the primary mounting member.

As depicted in FIGS. 16-17, the second crossbar 72 penetrates the primary body upper recess 316 and the secondary body upper recess 416. This configuration helps keep the second crossbar 72 in position in the primary body upper recess 316 and secondary body upper recess 416 of the mounting members 310, 410.

As shown in FIG. 17, a second winch 74 can be attached to the second winch platform 342 of the primary mounting member 310. One or more fasteners can be used to secure the second winch 74 to the primary mounting member 310 by inserting fasteners into the at least one first primary arm body opening 322. A protruding portion of the second winch 74, such as a second winch axis, can be positioned in the first primary arm recess 328 which supports the protruding portion of the second winch 74. The second winch 74 can be used to operate the second hoist device 70. Any suitable winch can be utilized with the manhole guard 2 of the present disclosure.

Referring now to FIG. 16, there is illustrated an embodiment of a fully assembled manhole guard 2 including a first hoist assembly 48 and a second hoist assembly 78. The first mounting bracket 150 is aligned with the second mounting bracket 250. A first crossbar 42 extends between the first mounting bracket 150 and the second mounting bracket 250. A first hoist device 40 is suspended from the first crossbar 42. In addition, the first mounting member 310 is aligned with the second mounting member 410. A second crossbar 72 extends between the first mounting member 310 and the second mounting member 410. A second hoist device 70 is suspended from the second crossbar 72.

The first winch platform 46 and the second winch platform 342 may be on opposing sides of the manhole guard 2. Although the first winch platform 46 and second winch platform 342 can be on the same side of the manhole guard 2, such a configuration can be crowded and movement of each winch 44, 74 may be obstructed by the presence of the other winch 44, 74. Therefore, it is preferable that the first winch platform 46 containing the first winch 44 is located on the second wing section 200 of the manhole guard 2 and the second winch platform 342 containing the second winch 74 is located on the first wing section 100 of the manhole guard 2. Moreover, it is preferable that the second winch platform 342 is located on the outer side of the primary mounting member 310 so as to not interfere with operation of the second hoist device 70 and to facilitate use of the second winch 74 exterior to the manhole guard 2. However, other configurations are encompassed within the scope of the present disclosure.

Referring now to FIGS. 18-21, further provided herein is a safety net 500 usable in connection with any safety barricade. As seen in FIGS. 18-21, some embodiments of a manhole guard 2 may include a safety net 500. The safety net 500 can be configured to be removably attached to the manhole guard 2. When attached to the manhole guard 2, the safety net 500 is configured to block debris from entering an open manhole while workers are present.

The safety net 500 may be composed of a single continuous piece having a size and shape capable of covering some sections or all sections of the manhole guard 2. In the alternative, the safety net 500 may be composed of several pieces with each individual piece having a size and shape configured to cover a specific section of the manhole guard 2. In the embodiments shown in FIGS. 18-19, the manhole guard 2 has three sections 10, 100, 200 and each section has its own corresponding safety net 500A, 500B, 500C. This beneficial configuration offers flexibility by providing a user with the option to cover any number of sections of the manhole guard 2 with a safety net 500 based on preference or need.

The safety net 500 may be any size and shape suitable to attach to the manhole guard 2 and block debris. In the embodiments shown in FIGS. 18-19, the manhole guard 2 has three rectangular sections and three corresponding rectangular safety nets 500A, 500B, 500C. Each rectangular safety net 500A, 500B, 500C has a top 502, sides 504 and 506, and a bottom 508. The top 502 of the safety net 500 may include one or more rail attachment features 510 to attach the safety net 502 to a rail of the manhole guard 2. The sides 504, 506 of the safety net 500 may include one or more post attachment features 512 to attach the safety net 500 to a post of the manhole guard 2. The bottom 508 of the safety net 500 may include a high visibility toe board 514. The rail attachment features 510 and post attachment features 512 may be any suitable fastening mechanism such as, but not limited to, Velcro, buttons, ties, harness, magnets, etc.

Figure 18A:
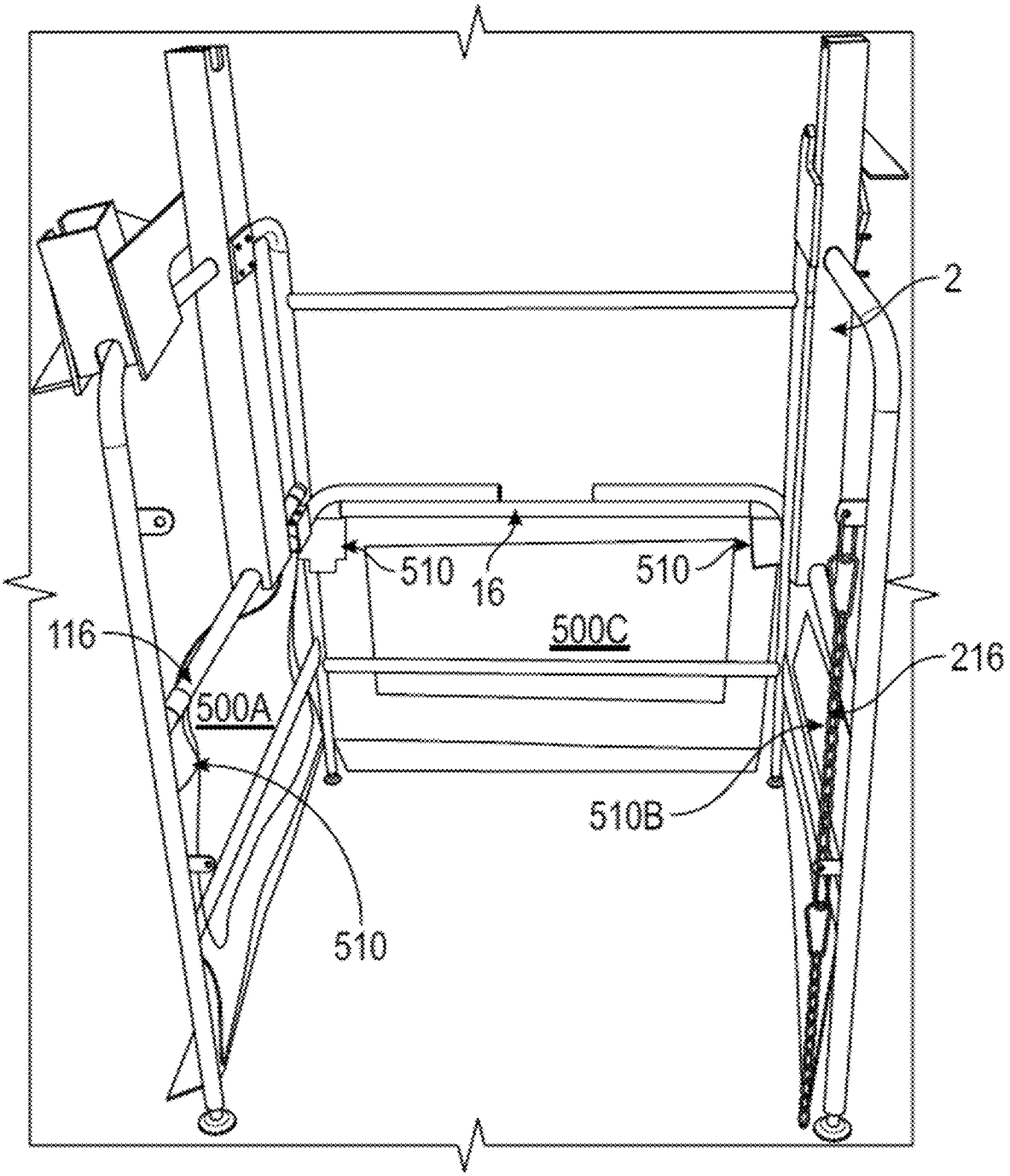
FIGS. 18A-18B: Views of a manhole guard containing a safety net.
Figure 18B:
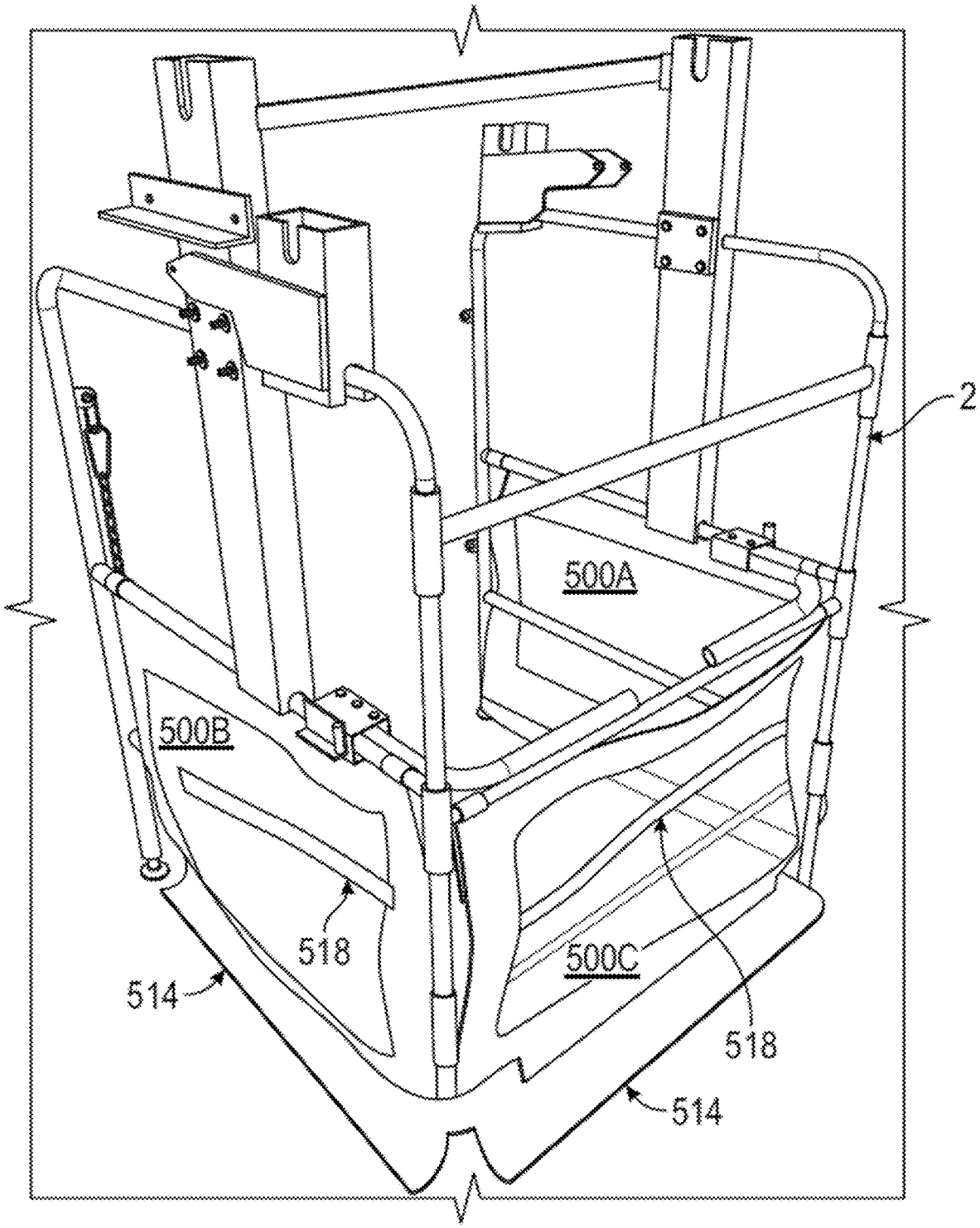

Referring to FIGS. 18A-18B, a first safety net 500A may be attached to a first wing 100, a second safety net 500B may be attached to a second wing 200, and a third safety net 500C may be attached to a center section 10 of the manhole guard 2. The first safety net 500A is attached to the first wing 100 by attaching the rail attachment features 510 to one of the first wing rails 116, 118, 120 and by attaching the post attachment features 512 on one side 504 of the first safety net 500A to the adjacent first post 12 and on the other side 506 of the first safety net 500A to the adjacent first wing post 112. The second safety net 500B is attached to the second wing 200 by attaching the rail attachment features 510 to one of the second wing rails 216, 218, 220 and by attaching the post attachment features 512 on one side 504 of the second safety net 500B to the adjacent second post 14 and on the other side 506 of the second safety net 500B to the adjacent second wing post 214. The third safety net 500C is attached to the center section 10 by attaching the rail attachment features 510 to one of the center rails 16, 18, 20 and by attaching the post attachment features 512 on one side 504 of the third safety net 500C to the adjacent first post 12 and on the other side 506 of the third safety net 500C to the adjacent second post 14. It is preferable to attach the safety net 500 to a rail 16, 18, 20, 116, 118, 120, 216, 218, 220 at a height no greater than the height of the safety net 500 such that the bottom 508 of the safety net 500 reaches the ground and blocks debris from entering the manhole. However, this is not strictly necessary.

Figure 19:
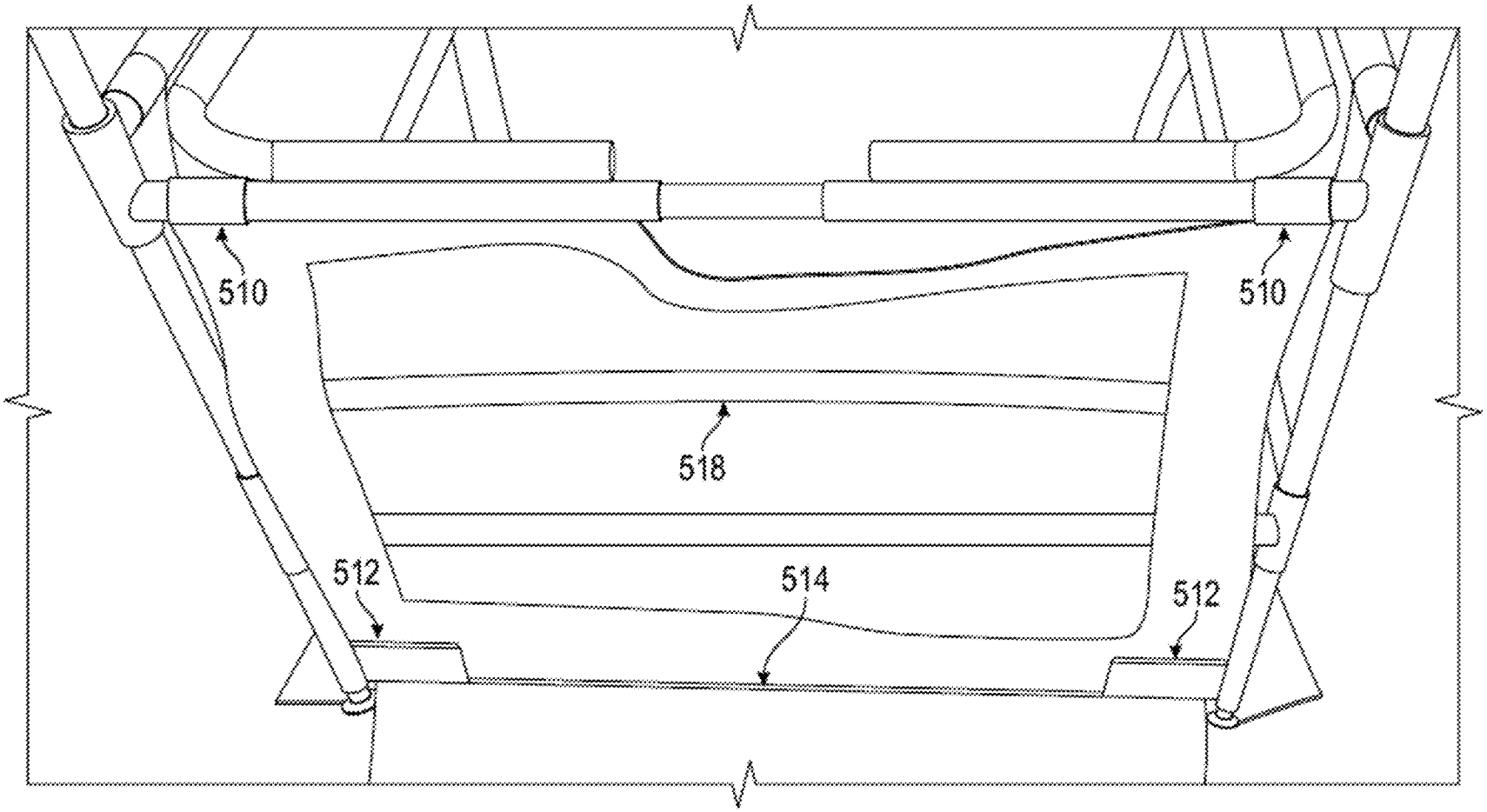
FIG. 19: Photograph showing a safety net attached to the center section by rail attachment features and post attachment features.
Figure 20:
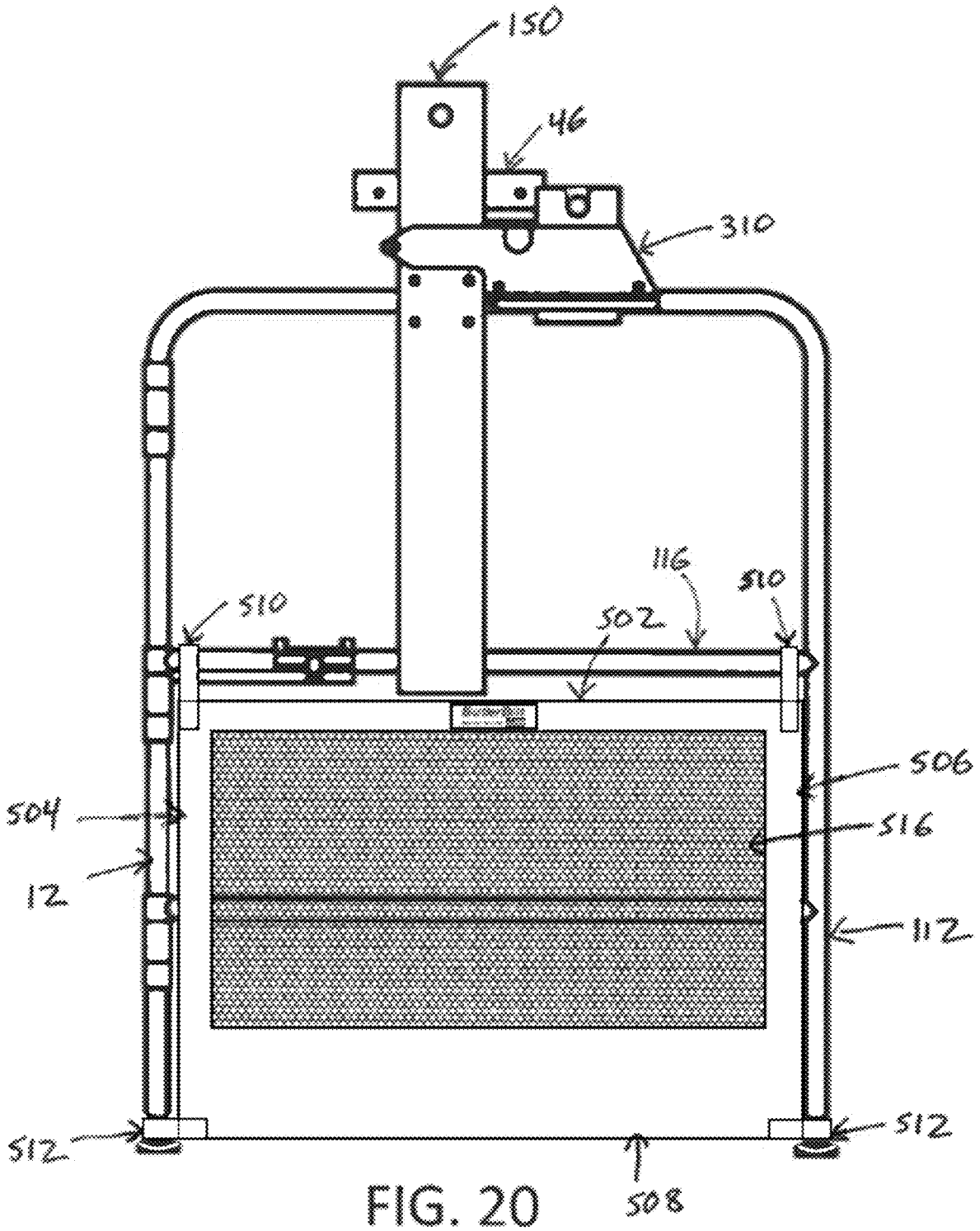
FIG. 20: Side view of a manhole guard with attached mounting brackets, mounting members, and safety net.
Figure 21:
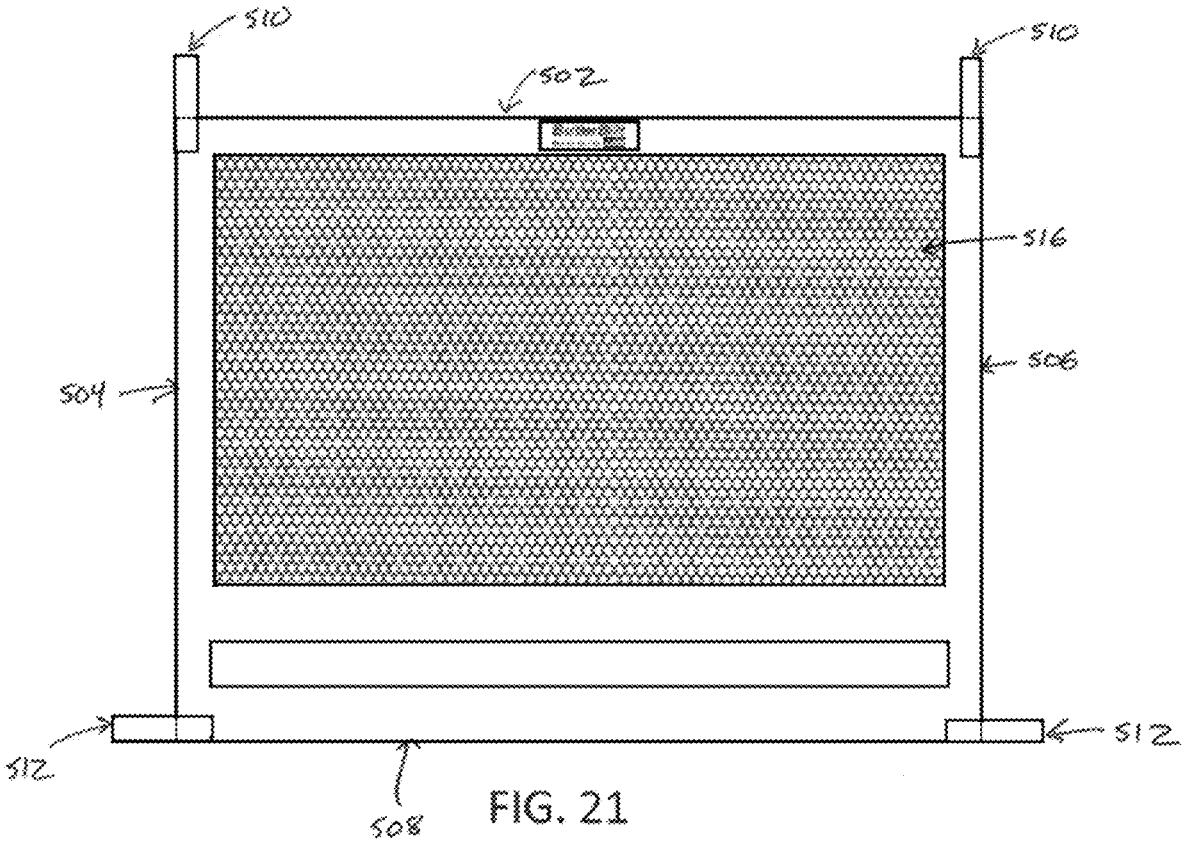
FIG. 21: View of a safety net with rail attachment features and post attachment features.

The safety net 500 can be made of a variety of materials such as a woven material, fabric, plastic, metal, or the like. In some embodiments, the safety net 500 includes openings 516 which allow a person to see through the safety net 500. For example, the safety net 500 shown in FIGS. 20-21 is made from a woven material and contains openings 516. In other embodiments, the safety net 500 may be made of a translucent material such as a plastic. For example, the safety net 500 depicted in FIGS. 18-19 is made from a translucent plastic. The safety net 500 may also include one or more reflective materials to increase the visibility of the manhole guard 2 in order to improve safety. In the embodiments shown in FIGS. 18-19, the safety net 500 includes a reflective tape 518.

While the invention has been described with reference to multiple embodiments, it should be understood by those skilled in the art that various changes may be made and equivalents may be substituted without departing from the essential scope and spirit of the invention. In addition, many modifications may be made to adapt a particular situation or material to the teachings of the invention without departing from its essential scope. Therefore, it is intended that the invention not be limited to the particular embodiments disclosed in the present specification, but that the invention will include all embodiments falling within the scope of the claims.

What is claimed is:

1. A manhole guard comprising:

a plurality of sections connected for movement, the sections including a center section, a first wing, and a second wing, wherein the center section comprises a first post and a second post connected by at least one center section rail, the first wing comprises a first wing post connected to the first post by at least one of an upper first wing rail and a lower first wing rail, and the second wing comprises a second wing post connected to the second post by at least one of an upper second wing rail and a lower second wing rail;

a first hoist assembly comprising a first mounting bracket connected to the first wing on the upper first wing rail and one of a middle first wing rail or the lower first wing rail, and a second mounting bracket connected to the second wing on the upper second wing rail and one of a middle second wing rail or the lower second wing rail; and a second hoist assembly comprising a primary mounting member connected to the first wing and to the first mounting bracket, and a secondary mounting member connected to the second wing and to the second mounting bracket.

2. The manhole guard of claim 1, further comprising a safety net attached to one or more of the first wing, the second wing, and the center section.

3. The manhole guard of claim 2, wherein the safety net includes a reflective material.

4. The manhole guard of claim 2, wherein the safety net includes a toe board.

5. The manhole guard of claim 1, wherein:

the primary mounting member has a primary body, a first primary arm connected to the primary body, and a second primary arm connected to the primary body;

the secondary mounting member has a secondary body, a first secondary arm connected to the secondary body, and a second secondary arm connected to the secondary body; and the manhole guard further comprises a crossbar extending between the primary mounting member and the secondary mounting member and engaging the primary mounting member and the secondary mounting member; and a hoist device attached to the crossbar.

6. The manhole guard of claim 5, wherein the primary body further includes a primary body lower recess and a primary body upper recess.

7. The manhole guard of claim 6, wherein the secondary body further includes a secondary body lower recess and a secondary body upper recess.

8. The manhole guard of claim 7, wherein the first primary arm includes a first primary arm body and a first primary arm extension extending from the first primary arm body.

9. The manhole guard of claim 8, wherein the second primary arm includes a second primary arm body and a second primary arm extension extending from the second primary arm body.

10. The manhole guard of claim 9, wherein the first primary arm extension includes a first primary arm extension opening, and wherein the second primary arm extension includes a second primary arm extension opening.

11. The manhole guard of claim 5, wherein the primary mounting member further includes a primary bridging member extending between the first primary arm and the second primary arm and connected to the first primary arm and the second primary arm; and wherein the secondary mounting member further includes a secondary bridging member extending between the first secondary arm and the second secondary arm and connected to the first secondary arm and the second secondary arm.

12. The manhole guard of claim 5, wherein the primary mounting member further includes a winch platform.

13. The manhole guard of claim 12, wherein the winch platform is attached to the primary body or to the first primary arm or to both the primary body and the first primary arm.

14. The manhole guard of claim 13, wherein a winch is attached to the winch platform.

15. The manhole guard of claim 14, wherein the first primary arm includes at least one first primary arm body opening.

16. The manhole guard of claim 15, wherein fasteners secure the winch to the winch platform using the at least one primary arm body opening.

* * * * *